US006655465B2

(12) United States Patent
Carlson et al.

(10) Patent No.: US 6,655,465 B2
(45) Date of Patent: Dec. 2, 2003

(54) BLADE CONTROL APPARATUSES AND METHODS FOR AN EARTH-MOVING MACHINE

(76) Inventors: David S. Carlson, 50 Follen St., Apt 506, Cambridge, MA (US) 02138; James R. Brooks, 74 Otis St., Apt 2, Cambridge, MA (US) 02141; Ronald H. Soczawa, 3131 Brentwood Dr., SE., Grand Rapids, MI (US) 49506; Frederick A. Rogers, 9900 Snow Ridge Dr., Alto, MI (US) 49302

( * ) Notice: Subject to any disclaimer, the term of this patent is extended or adjusted under 35 U.S.C. 154(b) by 0 days.

(21) Appl. No.: 10/094,847

(22) Filed: Mar. 11, 2002

(65) Prior Publication Data

US 2002/0162668 A1 Nov. 7, 2002

Related U.S. Application Data

(60) Provisional application No. 60/276,113, filed on Mar. 16, 2001, and provisional application No. 60/276,067, filed on Mar. 16, 2001.

(51) Int. Cl.[7] ..... E02F 3/76; H04B 7/85

(52) U.S. Cl. ..... 172/4.5; 37/906; 37/907; 701/50; 701/216; 356/375; 356/376; 342/357.06; 342/357.17; 342/451

(58) Field of Search ..... 172/4.5, 4, 2; 37/906, 37/907, 348; 356/375, 376; 342/357.06, 357.01, 357.17, 451, 457; 701/50, 207, 213, 214, 216

(56) References Cited

U.S. PATENT DOCUMENTS

| | | | | |
|---|---|---|---|---|
| 4,807,131 | A | 2/1989 | Clegg | 172/4.5 X |
| 5,375,663 | A | 12/1994 | Teach | 172/4.5 |
| 5,905,968 | A | 5/1999 | Staub et al. | 702/150 |
| 6,112,145 | A | 8/2000 | Zachman | 701/50 |
| 6,152,238 | A | 11/2000 | Ferrell et al. | 172/2 |
| 6,191,732 | B1 | 2/2001 | Carlson et al. | 342/357.06 |

OTHER PUBLICATIONS

SonicMaster 2000 Operation Manual, Laser Alignment Inc. 2000.

*Primary Examiner*—Christopher J. Novosad
(74) *Attorney, Agent, or Firm*—Richard L. Sampson, Esq.

(57) ABSTRACT

A method and apparatus for providing for real time automated control of the position of a blade on a earth-moving machine. The method includes providing a geography altering machine, including a blade and a computer, the computer having stored therein a reference line and a three dimensional computer model of a desired topography, providing a user defined offset relative to the reference line, determining a blade position in local coordinates, converting the local coordinates to reference line coordinates, utilizing the reference line coordinates and the user defined offset to calculate blade movement commands, and moving the blade in a direction required by the blade movement commands.

83 Claims, 17 Drawing Sheets

BLADE CONTROL APPARATUSES AND METHODS FOR AN EARTH-MOVING MACHINE

RELATED APPLICATIONS

This application claims the benefit of U.S. Provisional Application No. 60/276,113 entitled LATERAL POSITION CONTROL OF CUTTING BLADE USING GLOBAL POSITIONING SYSTEM filed on Mar. 16, 2002; and Application No. 60/276,067 entitled CROSS-SLOPE AND HOLD SLOPE OF CUTTING BLADE USING GLOBAL POSITIONING SYSTEM filed on Mar. 16, 2001.

BACKGROUND OF THE INVENTION (1) Field of the Invention

The present invention generally relates to earth-working systems, and more particularly, to an apparatus and method for providing real time control of a cutting blade.

(2) Background Information

Relatively sophisticated and powerful geography altering, earth-moving, and/or earth-working machinery have been developed to recontour the topography of large tracts of land, or to otherwise alter the geography of a worksite such as a construction area, a mine, a roadbed, an airport runway, and the like. Machinery of this type (e.g., motor graders and bulldozers) typically include a cutting blade for cutting or sculpting the desired contour as shown in FIG. 1, which is a schematic of a motor grader 50 including a cutting blade 52 (also referred to as a mold board) for contouring a tract of earth.

The advent of computer technology and navigational systems such as satellite, laser, and gyroscope methods has led to the development of various control and/or automated mechanisms for various aspects of geography altering operations. For example U.S. Pat. No. 4,807,131 to Clegg discloses a system wherein an onboard computer receives detection signals from various detection units that are used to control the slope of an earth-engaging blade. U.S. Pat. No. 5,905,968 to Staub, et al., discloses an apparatus and method for controlling a blade on an earth-working machine to preserve a crown on the surface of a road having a sloped grade on either side of the crown. U.S. Pat. No. 6,112,145 to Zachman discloses a blade control system for an earth-working machine for working a surface of earth to a desired shape in which the desired cross slope is maintained when steering the motor grader through a turn (or otherwise articulating the frame).

Despite the advances disclosed in the above cited U.S. Patents, there exists a need for an improved automated control mechanisms for earth-working machines or vehicles, and, in particular, a system and method providing improved and/or expanded blade functionality.

SUMMARY OF THE INVENTION

One aspect of the present invention includes a method for real time automated control of the position of a blade on a geography-altering machine. The method includes providing a geography altering machine, including a blade and a computer, the computer having stored therein a reference line and a three-dimensional computer model of a desired topography and providing a user defined offset relative to the reference line. The method further includes determining a blade position in local coordinates, converting the local coordinates to reference line coordinates, the reference line coordinates including a reference station value and a reference offset value, utilizing the reference line coordinates and the user defined offset to calculate blade movement commands, and moving the blade in a direction required by the blade movement commands.

In another aspect, this invention includes a method for controlling in real time the position of a blade on a geography-altering machine. The method includes providing a geography altering machine, including a blade and a computer, the computer having stored therein a reference line and a three dimensional computer model of a desired topography of a work site and providing a user defined offset relative to the reference line. The method further includes determining a blade position in local coordinates. converting the local coordinates to reference line coordinates, the reference line coordinates including a reference station value and a reference offset value, calculating a slope along a segment orthogonal to the reference line at the reference station and extending the slope beyond the user defined offset, which defines a temporary design surface, and moving the blade so that the actual cross slope of the blade is substantially equal to the slope of the temporary design surface.

In yet another aspect, the present invention includes an earth-working machine. The earth-working machine includes: a blade, a blade controller configured for moving the blade, and a computer having stored therein a reference line and a three-dimensional computer model of a desired topography. The computer is configured to prompt a user for a user defined offset relative to a reference line, determine a blade position in local coordinates, convert the local coordinates to reference line coordinates, including reference station and reference offset values, calculate a slope along a segment orthogonal to the reference line at the reference station and extend the slope beyond the user defined offset, defining a temporary design surface, and send blade movement commands to the blade controller for moving the said blade so that the actual cross slope of the blade is substantially equal to the slope of the temporary design surface.

In a further aspect, the present invention includes a method for controlling in real time the position of a blade on a geography-altering machine. The method includes providing a geography-altering machine, including a blade and a computer, the computer having stored therein a reference line for a work site and providing a user defined offset value relative to the reference line. The method further includes determining a blade position in local coordinates, converting the local coordinates to reference line coordinates, the reference line coordinates including a reference station value and a reference offset value, comparing the user defined offset to the reference offset, and moving the blade in a lateral direction relative to the geography altering machine to a position wherein the reference offset is substantially equal to the user defined offset.

In still a further aspect, the present invention includes an earth-working machine. The earth-working machine includes a blade, a blade controller for moving the blade, and a computer having stored therein a reference line and a three dimensional computer model of a desired topography. The computer is configured to prompt a user for a user defined offset relative to a reference line, determine a blade position in local coordinates, convert the local coordinates to reference line coordinates, including reference station and reference offset values, compare the user defined offset to the reference offset, and send blade movement commands to the blade controller.

In yet a further aspect, this invention includes a graphical user interface for displaying in real time the position of a blade on a geography-altering machine relative to a work site. The graphical user interface includes a display selected from the group consisting of: a top plan view including the current position of the machine and the blade, a cross sectional elevational view including a vertical line representing the reference line, and the actual position of the blade taken along a plane parallel to the longitudinal axis of the blade, and numeric indicia representing the station and offset values.

DETAILED DESCRIPTION

Figure 1:
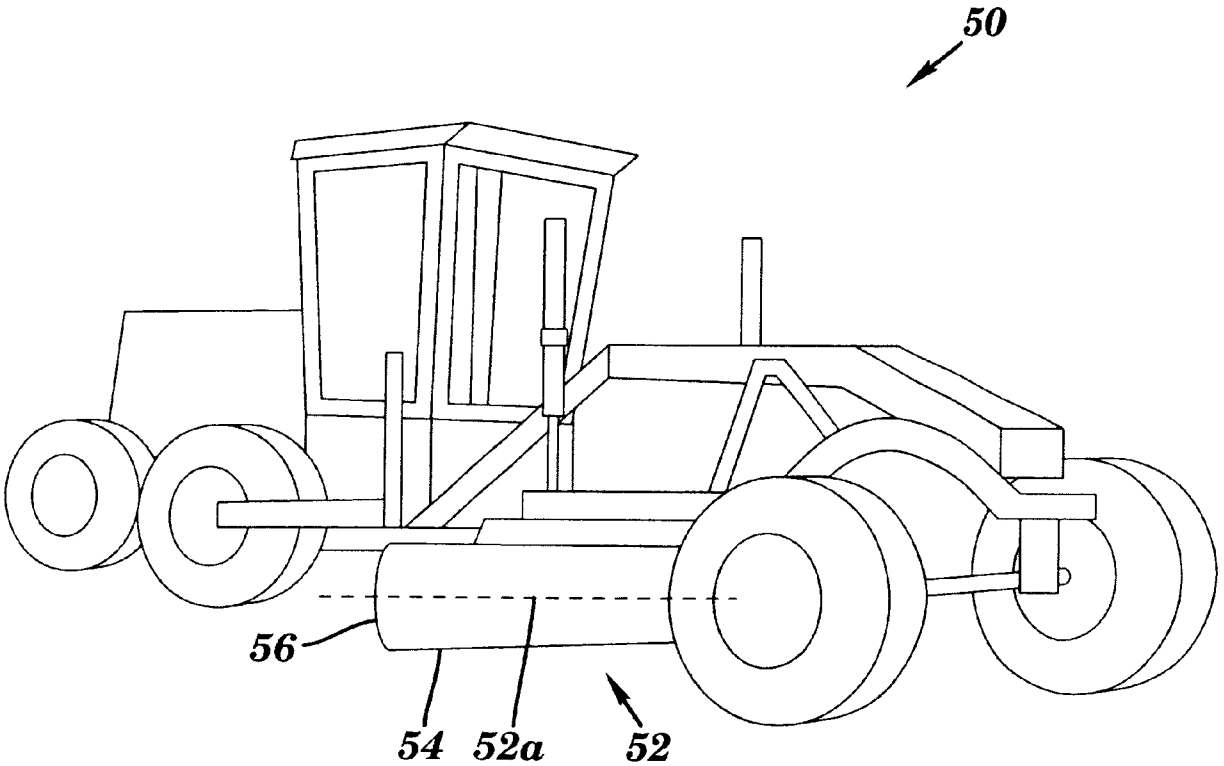
FIG. 1 PRIOR ART
FIG. 1 is a schematic representation of one example of a conventional earth-working vehicle including a cutting blade, with which the present invention may be practiced.
Figure 2:
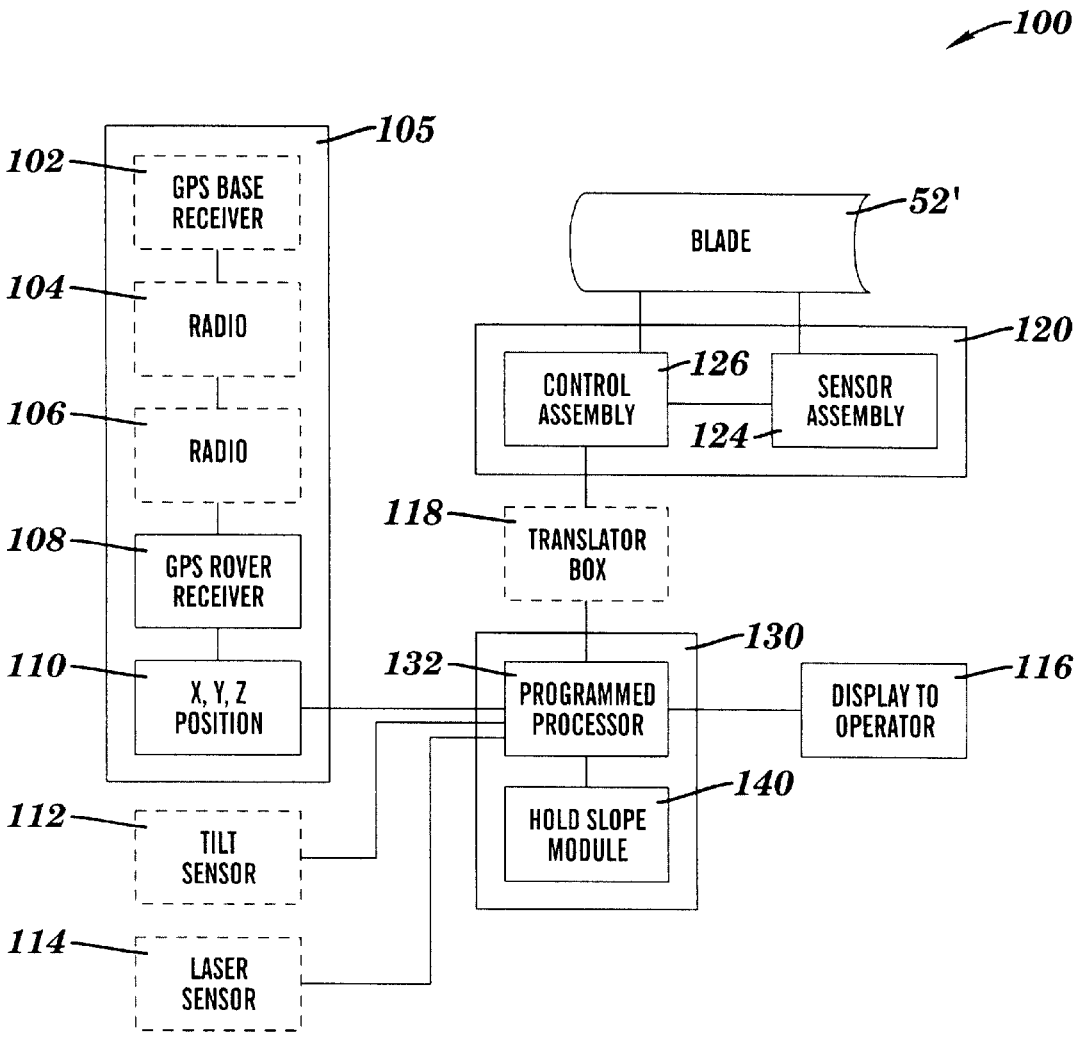
FIG. 2 is a block diagram of an earth-working system of the present invention for use in a vehicle such as that shown in FIG. 1.
Figure 3:
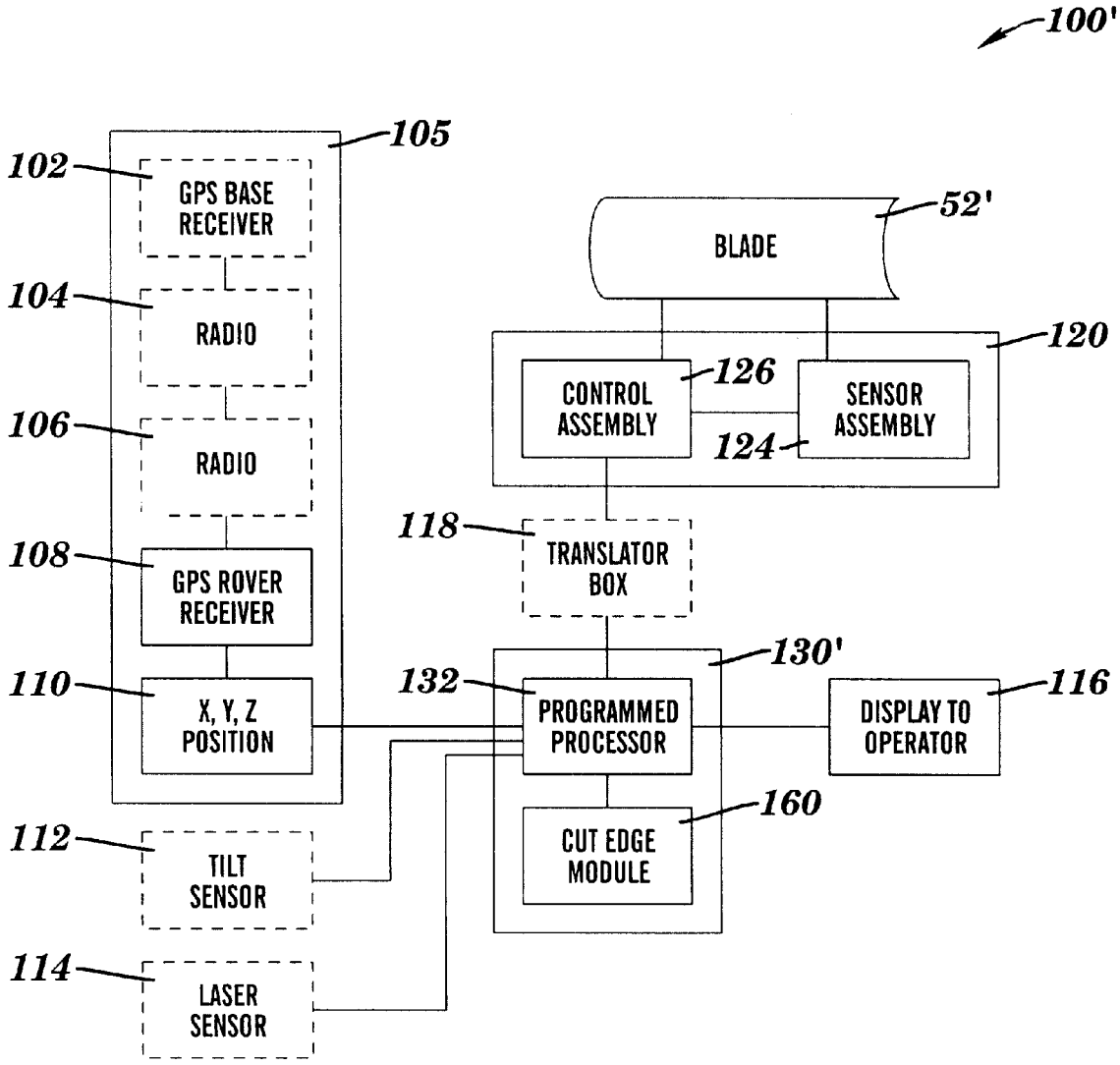
FIG. 3 is a diagram similar to that of FIG. 2, of another earth-working system of the present invention.
Figure 4:
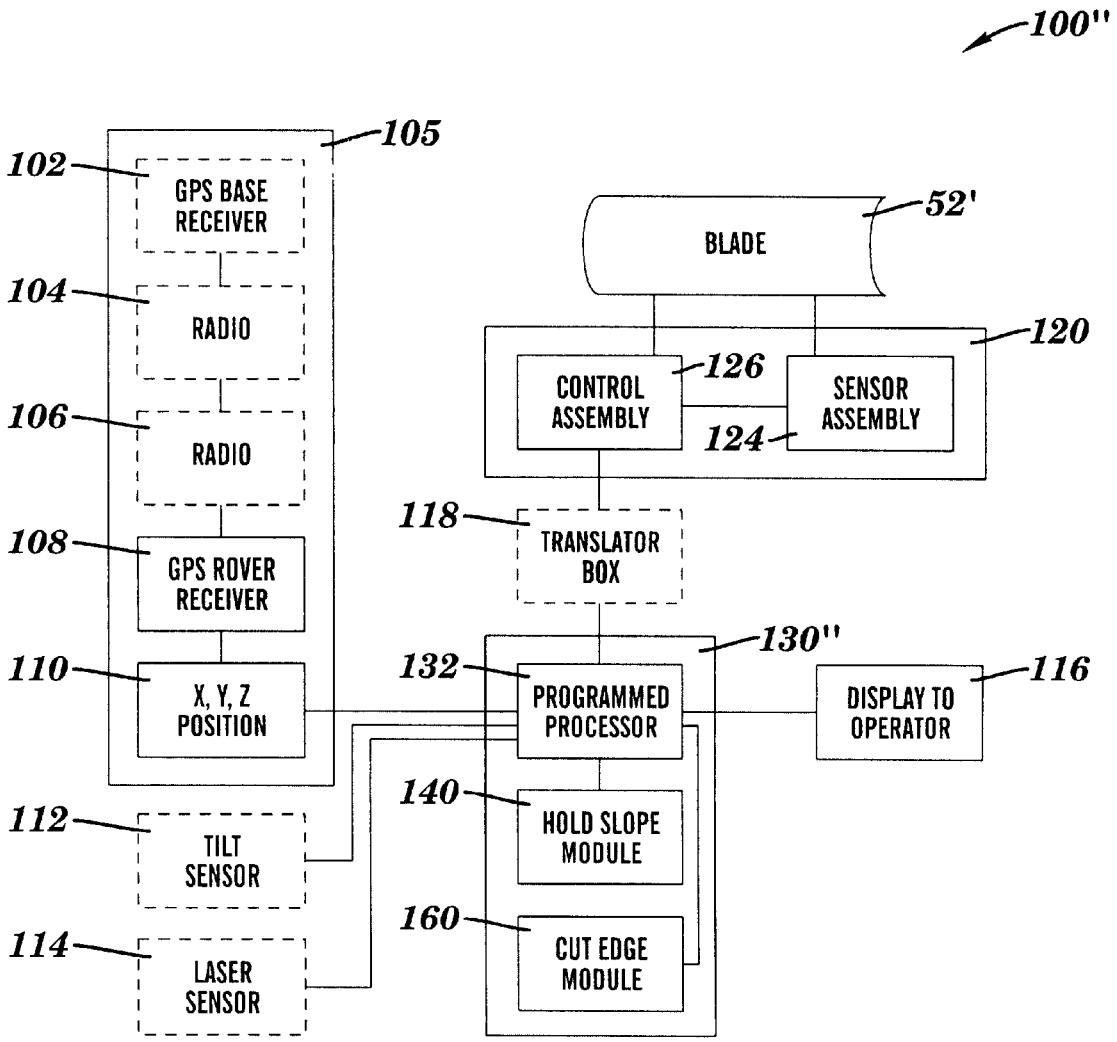
FIG. 4 is a diagram similar to that of FIGS. 2 and 3 of yet another earth-working system of the present invention.

Referring to the FIGS. 2–4, a system and method constructed according to the principles of the present invention is shown. Briefly described, the present invention includes an apparatus and method for providing automated control of the position (including in particular, the cross slope and/or the lateral position) of a blade 52' of an earth-working machine (e.g., vehicle 50 in FIG. 1). The system 100, 100', 100" of this invention includes a three-dimensional positioning system 105, a controller 120, and a system module 130, 130', 130". System module 130 includes a hold-slope module 140 for providing advanced automated cross slope functionality to system 100. System module 130' includes a cut-edge module 160 for providing automated edge cutting and or filling functionality to system 100', by controlling lateral movement of the blade relative to the machine 50. System module 130" includes a hold-slope module 140 and a cut-edge module 160 for providing both cross slope and edge cutting or filling functionality, either individually or simultaneously, to system 100".

This invention is potentially advantageous in that it provides for improved blade functionality and increased flexibility in use. This invention tends to be particularly useful when recontouring sites having boundary lines where the slope changes from one value to another (e.g., the boundary between a road bed and a drainage ditch or the boundary between a road bed and a building site) or where there is a step function elevation change (e.g., the boundary between a roadbed and a curb or sidewalk). In typical prior art systems, when a user moves a portion of the blade across a boundary line the system tends to cause severe blade movement as it attempts to compensate for the discontinuous design surface. This invention is advantageous in that it enables a user to maintain a cross slope while crossing a boundary line or otherwise positioning a portion of the blade thereover. For example, a user may cut the left side of a roadbed with a portion of the blade overlaying the crown (which is a boundary line where the slope typically changes from 2% to −2%). In another example, a user may cut an edge (or boundary line) having a step function elevation change without relatively small changes in blade position causing potentially violent blade movements. This invention is further advantageous in that it allows a user to cross a boundary line in site regions having continuous slope changes (e.g., the banked corner of a roadbed) while cutting or filling the changing slope. Further advantageous, this invention enables a user to precisely cut or fill an edge at a predetermined distance from a reference line (e.g., a ditch along the side of a roadbed). Additional advantages of this invention are discussed hereinbelow along with a more detailed description of the invention.

Where used in this disclosure, the terms "computer" and/or "programmed processor" shall refer to any suitable processing device including, a programmable digital computer, microprocessor, microcontroller, etc., including dedicated, embedded, and general purpose computers and workstations. As used herein, the terms "earth-working machine", "earth-working vehicle", and "geography altering machine" shall refer to any self-propelled, mobile machine, such as graders, bulldozers, tractors, loaders, and the like that have the capacity to alter the geography of a worksite. The term "blade" shall refer to the implement or tool by which an earth-working machine alters the geography of a worksite, such as a blade, a mold board, a plow, a bucket or a shovel. Blade 52, 52' (FIGS. 1–4) includes a longitudinal cutting edge 54 that extends substantially parallel to longitudinal axis 52a. Blade 52, 52' may further include one or more transverse cutting edges disposed at opposite ends 56 thereof. The skilled artisan will readily recognize that the portions of the blade 52, 52' defined above may be present on other earth working implements (e.g., the longitudinal cutting edge of a bucket may include the tines of the bucket). The terms "slope" and/or "cross slope" refers to the slope of the longitudinal cutting edge 54 and/or a site plan, relative to a level surface. Also as used herein, the term "GPS" shall refer to any navigational system, whether satellite-based or non-satellite-based (including aircraft based systems), including the United States Global Positioning System, known as GPS, the Russian Global Orbitting Navigator Satellite System, known as GLONASS, or any other system capable of providing three-dimensional position data to a signal receiver. The term "real time" refers to a rate of data update that is sufficiently high so as to be useful to an operator of a geography altering machine during cut and fill operations, such as, for example, several times a minute, or higher.

Referring now to FIG. 2, an earth-working system 100, incorporating one embodiment of the present invention therein, includes a controller 120 and a three dimensional positioning system 105, each connected to a system module 130. The connections are typically made by conventional wiring or cable (e.g., an RS232 serial connection), but may also be wireless connections that provide for electronic communication (e.g., infrared, microwave, or radio frequency). Controller 120 may optionally be connected to system module 130 through a translation box 118 that converts the signals provided by system module 130 into a form suitable for use by controller 120.

Controller 120 functions to provide positional control of blade 52' and includes a control assembly 126 and a sensor assembly 124. Control assembly 126 and sensor assembly 124 may be stand-alone units or included together in a single self-contained unit. Sensor assembly 124 includes one or more sensors (e.g., an ultrasonic transducer) for determining the position of blade 52' (including the slope thereof) relative to a fixed reference (e.g., relative to the frame of the vehicle). Control assembly 126 utilizes the measurement data provided by sensor assembly 124, along with instructions provided by system module 130, to adjust the position of blade 52', to effect desired cut and fill operations. Control assembly 126 may use any known positioning device to adjust the position of blade 52', but typically utilizes conventional hydraulic cylinders. One example of controller 120 is disclosed in significantly more detail in U.S. Pat. No. 6,152,238 to Ferrell et al., which is fully incorporated herein by reference, and is hereafter referred to as the '238 patent. A similar exemplary controller 120 is the SonicMaster® 2000, manufactured and sold by Laser Alignment®, Inc., S.E. Grand Rapids, Mich. Many of the features of SonicMaster® are also described in co-Applicant's "SonicMaster® 2000 Operation Manual" by Laser Alignment®, Inc., which is fully incorporated by reference herein.

Three-dimensional positioning system 105 includes a GPS (or other similar positioning system) mobile receiver (referred to herein as a rover receiver or GPS receiving antenna) 108 disposed on a vehicle, such as on earth-working machine 50 (FIG. 1). In one embodiment, a rover receiver 108 is disposed on one end 56 (or both ends) of the blade 52', as discussed hereinbelow. In other embodiments, rover receiver 108 is disposed at a predetermined location on the frame of machine 50. Rover receiver 108 is adapted to receive GPS (i.e. position) signals from a GPS satellite system (typically including numerous satellites). The signals are utilized in a known manner, to determine the actual two- or three-dimensional position as shown at block 110, of a signal-receiving portion of an antenna (not shown) associated with GPS rover receiver 108. In the event the receiver 108 is disposed on the frame of machine 50, sensor assembly 124 may be used to determine the actual position of the blade 52' based on sensed distances from a reference point on machine 50. The two- or three-dimensional coordinate position calculated at 110 is then supplied to a system module 130.

In the event the positioning system 105 is configured to receive only two-dimensional data, e.g., horizontal ('x' and 'y' axis) data, or in the event redundant data in one or more dimensions, e.g., elevation ('z' axis) is desired, additional positioning means may be provided. For example, as will be discussed in greater detail hereinbelow, system 100 may optionally include a conventional laser sensor 114 mounted to an earth-working vehicle (e.g., on blade 52') for providing precise measurement of vertical (e.g., 'z' axis) position. (Laser systems are well known in the art and are therefore not discussed in detail herein. Typical laser systems, including a laser sensor mounted to an earth-working machine, are discussed in more detail in U.S. Pat. No. 4,807,131 to Clegg and U.S. Pat. No. 5,375,663 to Teach, each of which is fully incorporated herein by reference.)

As shown in phantom, system 100 may optionally include pitch and roll tilt sensors 112 for providing tilt data along at least one axis to system module 130. The tilt data may be used in combination with the above described GPS signals to calculate the three-dimensional (e.g., x, y, z coordinate) position of one or more points on the earth's surface disposed beneath the vehicle (e.g., to calculate the position of a point of contact between machine 50 and the ground in the event the machine 50 is tilted relative to the horizontal) as disclosed in U.S. Pat. No. 6,191,732 to Carlson, et al., (which is fully incorporated herein by reference and is hereafter referred to as the '732 patent). Rover receiver 108 may be optionally adapted to receive GPS signals from both a GPS satellite system and a GPS base receiver 102. Such a base receiver 102 is disposed at a pre-determined, stationary location. The base receiver may be disposed in communication with mobile rover receiver 108, such as by radio transceivers 104 and 106. This arrangement of base receiver 102 and rover receiver 108 corrects for any offsets within the GPS signals transmitted, for example, by the orbiting GPS satellites. It should be recognized, however, that the present invention may be practiced without the use of a base receiver 102, i.e., by using only signals generated by the GPS satellites or other positioning systems, without departing from the spirit and scope of the present invention provided that the three-dimensional positioning accuracy without the use of a base receiver 102 is adequate.

Accordingly, three-dimensional position data obtained by one or more of the aforementioned techniques is ultimately received by system module 130.

System module 130 includes a programmed processor 132 and a hold-slope module 140 for providing automated cross slope functionality to system 100. As described above, programmed processor 132 may be any suitable processing device, including an embedded device, or a general-purpose programmable computer. For example, programmed processor 132 may include a general-purpose computer such as a PC having a PENTIUM® processor (INTEL® Corp., Santa Clara, Calif.). Output generated by programmed processor 132 is typically communicated to an operator in any suitable manner, such as by a conventional flat panel or cathode ray tube display 118. Hold-slope module 140 is discussed in greater detail hereinbelow.

Referring now to FIG. 3, earth-working system 100', incorporating another embodiment of the present invention therein, is substantially similar to earth-working system 100, except that it includes cut-edge module 160 in place of hold-slope module 140. Cut-edge module 160 provides automated edge cutting or filling functionality to system 100' and is discussed in greater detail hereinbelow.

Referring now to FIG. 4, earth working system 100", incorporating yet another embodiment of the present invention therein, is substantially similar to earth working systems 100 and 100', except that it includes both hold-slope module 140 and edge cut module 160. Hold-slope module 140 and cut-edge module 160 typically may be implemented individually or simultaneously to provide dual functionality as discussed in greater detail hereinbelow.

Figure 5:
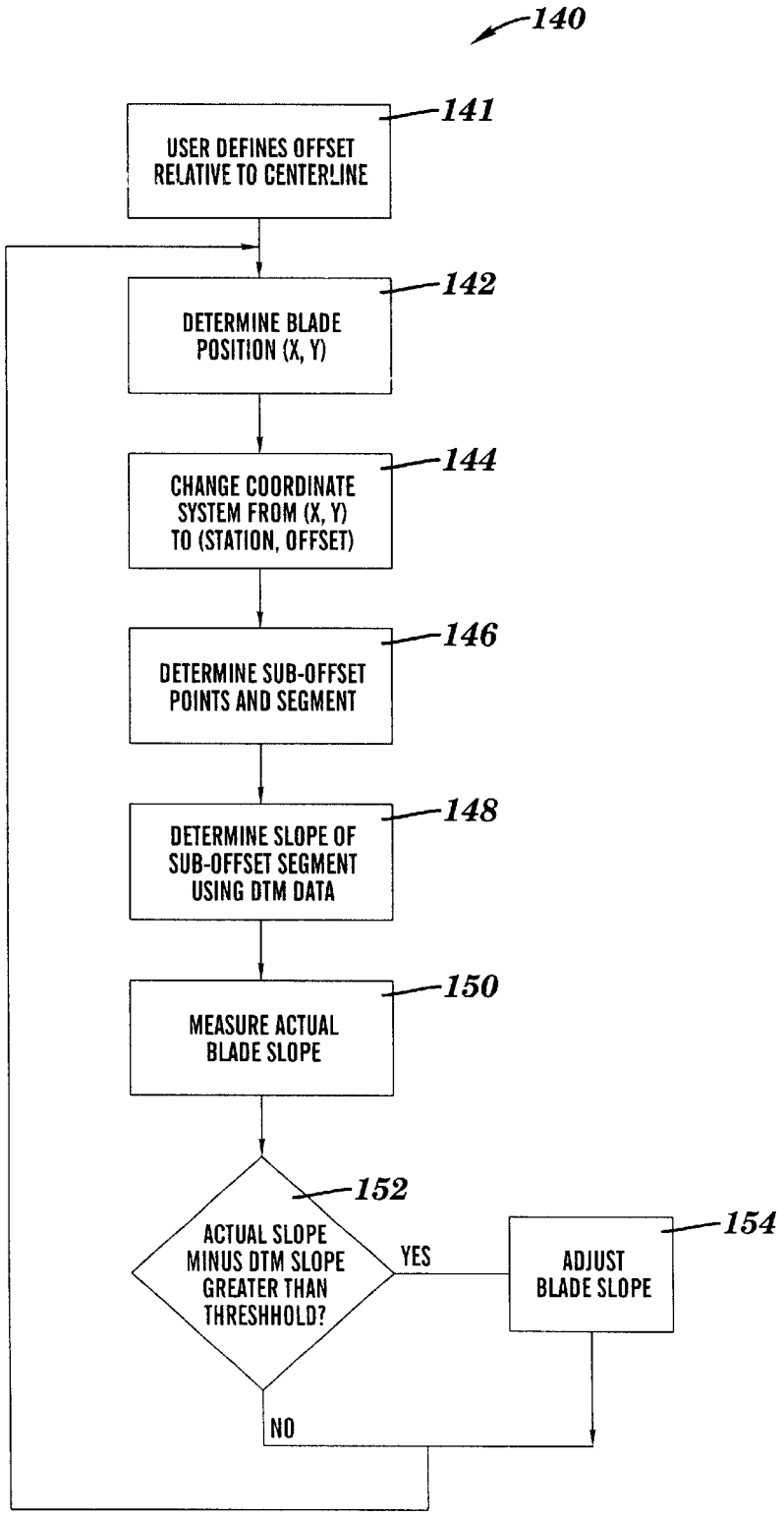
FIG. 5 is a flow chart representation of one embodiment of the hold-slope module of FIG. 2 and FIG. 4.

Referring to FIG. 5, a method of the present invention for cutting a cross slope in real time is implemented by hold-slope module 140 as is now described in greater detail. Hold-slope module 140 is particularly useful for worksites including boundary lines between regions having a step function change in target slopes and/or design heights. At block 141 a user provides an offset relative to a centerline or reference line (e.g., of a road to be constructed), typically while the earth-working vehicle 50 is stationary. (The term "offset" as used herein shall refer to a distance from the centerline along a direction orthogonal thereto.) In one embodiment a user positions the earth-working vehicle at a starting point. A GPS reading provides local Cartesian coordinates for the starting point, from which the user defined offset may be readily calculated, as discussed in more detail hereinbelow. As the earth-working vehicle traverses the site, the position of blade 52' is determined 142 at predetermined intervals by three-dimensional positioning system 105 as described hereinabove with respect to FIGS. 2–4. (The position is typically determined 142 by a GPS-based method, such as that disclosed in the '732 patent.) At block 144, the horizontal components (e.g., 'x' and 'y') of the position determined at block 142 are converted from local coordinates (e.g., Cartesian or 'x', 'y', and 'z' axes) to a centerline coordinate system (also referred to as a reference line coordinate system). The centerline coordinate system includes "station" and "offset" values (as opposed to the x and y values used in Cartesian coordinates) to define the location of a point on a worksite. The term "station" as used herein shall refer to the distance along the centerline from a predefined origin position (e.g., the intercept of the centerline with a plan edge). The term "offset" as used herein shall refer to the distance from the centerline along a direction orthogonal thereto. Cartesian coordinates may be converted to centerline coordinates using any of numerous well-known mathematical algorithms. One exemplary algorithm is discussed in more detail hereinbelow with respect to FIGS. 6A–6C. At block 146, two points (referred to as sub-offset points) are determined on either side of the user-defined offset along the normal to the centerline. These points are typically determined at predefined sub-offset values to the user defined offset (e.g., six inches). These two points define a segment for which a slope is calculated 148 using a digital terrain model (DTM). The DTM includes target elevation data for the finished site as a function of horizontal or lateral position (i.e., provides a target 'z' as a function of 'x' and 'y'). The DTM typically includes a grid file including elevation data for each lateral increment in the grid. The DTM may also include a Triangulation Irregular Network (TIN) file, which similarly includes three-dimensional data for the finished work-site. At block 150, hold-slope module 140 receives a real-time, actual measured slope value from controller 120, as discussed above with respect to FIGS. 2 and 4. At block 152 the measured slope for a given location is compared to the slope calculated at block 148. If the difference between the two values is greater than a predetermined threshold, hold-slope module 140 sends instructions at 154 to controller 120 to adjust the slope of the blade 52'. The difference between the two values may also include differences in elevation, so that adjustments to blade 52' may not only place the blade 52' parallel to the desired slope, but may substantially superimpose the blade 52' with the desired topography defined by the DTM. In the event the difference between the values is less than the predetermined threshold, the slope of blade 52' is left unchanged and hold-slope module 140 loops back to 142. Such looping back to 142 may occur in real time, e.g., within a range of from several times a minute up to 10 times a second or more. In the foregoing manner, the present invention provides for both cutting and filling to obtain a desired elevation, while also enabling the operator to conveniently obtain the desired cross-slope, at a given horizontal location.

Figure 6A:
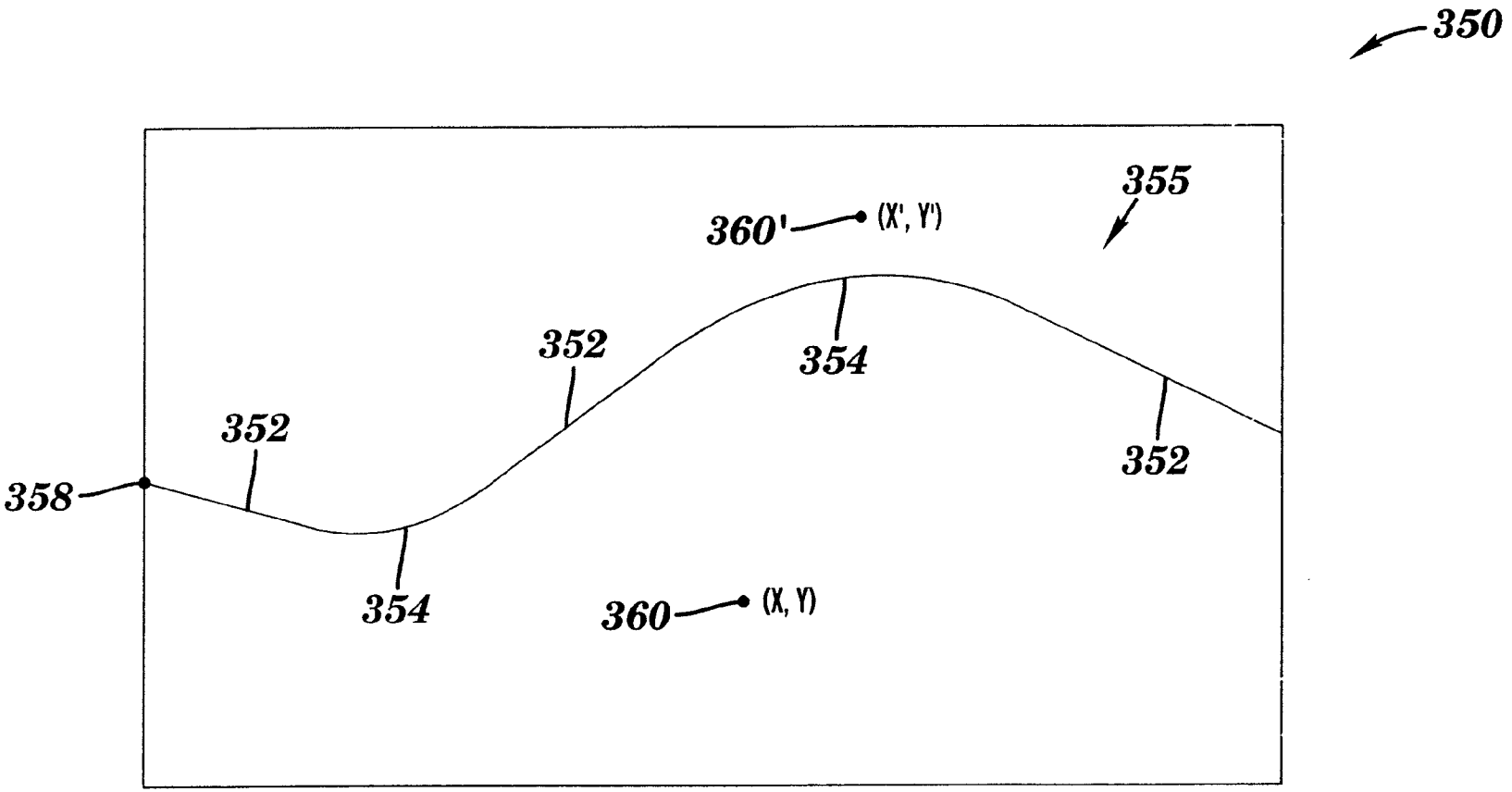
FIG. 6A is a schematic representation of a site including a centerline, at which the present invention may be used.
Figure 6B:
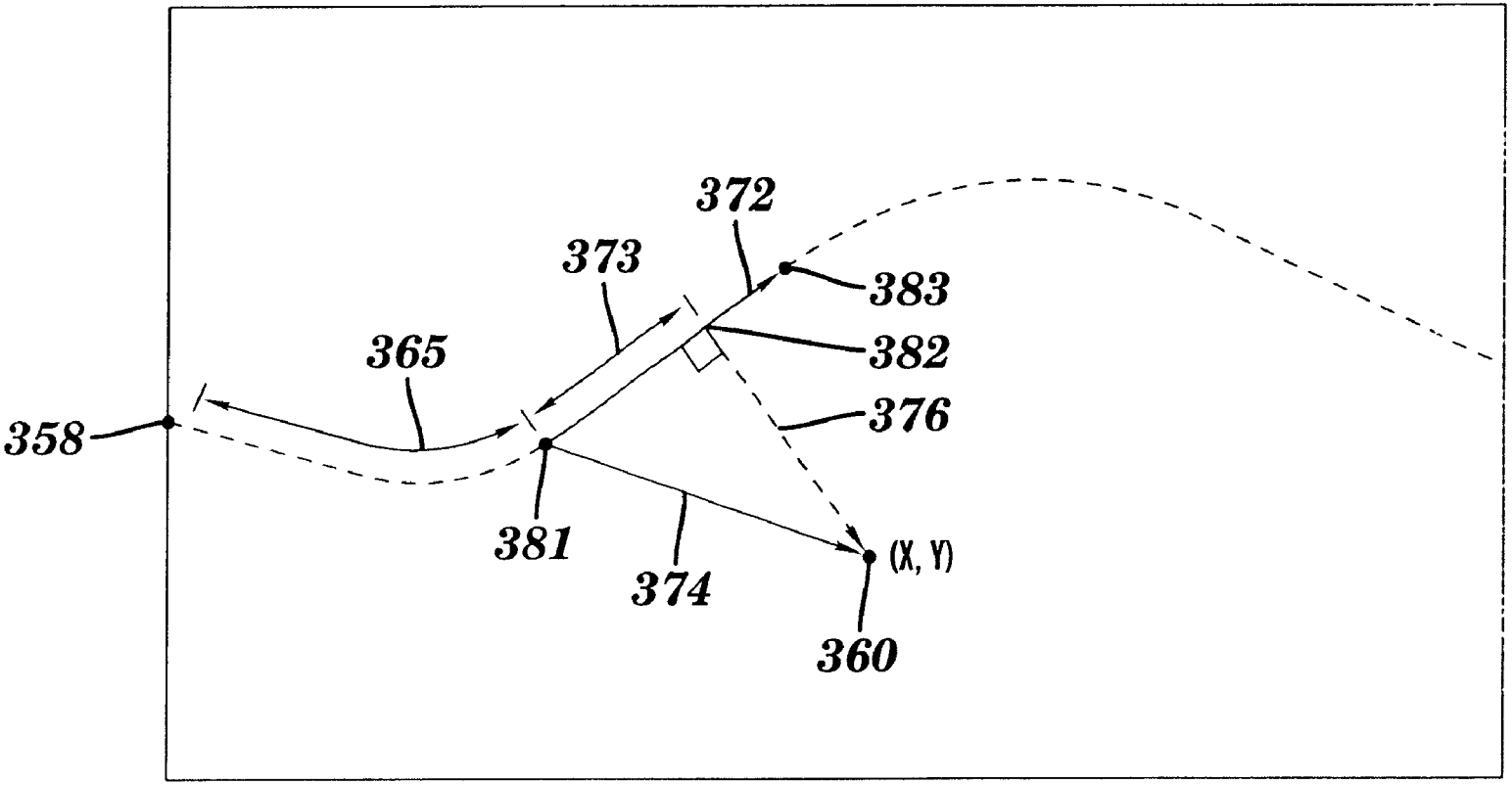
FIG. 6B is a schematic representation of the site of FIG. 6A illustrating a portion of an algorithm used by the present invention to convert Cartesian coordinates to centerline coordinates.
Figure 6C:
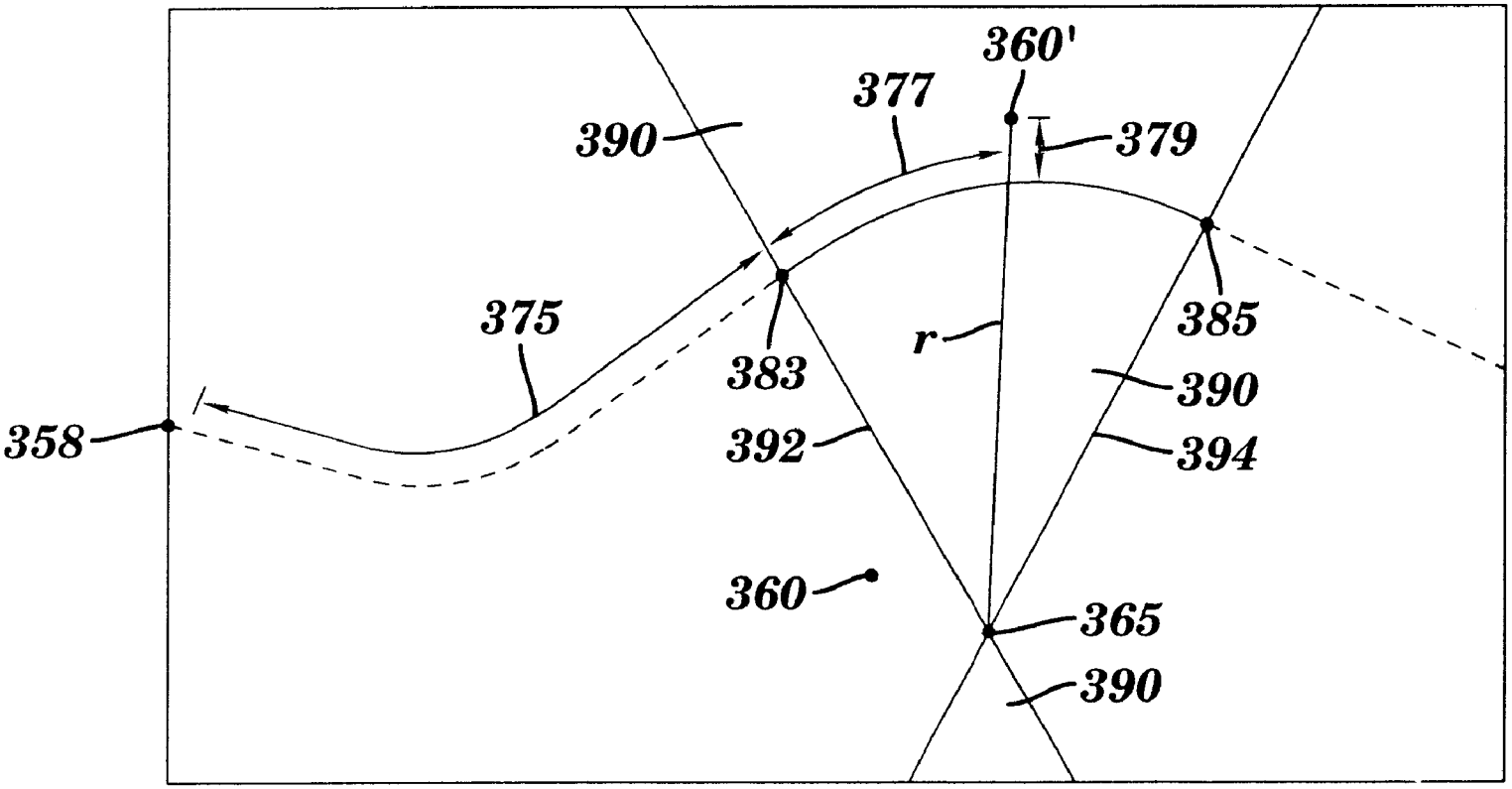
FIG. 6C is a schematic representation of the site of FIG. 6A illustrating another portion of an algorithm used by the present invention to convert Cartesian coordinates to centerline coordinates.

Referring now to FIGS. 6A–6C one algorithm usable by embodiments of the present invention for converting a position 360 in the worksite from Cartesian coordinates to centerline coordinates is discussed in more detail. Referring first to FIG. 6A, a site plan 350 typically includes a reference line 355 having an origin 358. In this example algorithm, the reference line is treated as a series of segments 352 (straight line sections) and arcs 354 (curved line sections). Beginning with the segment 352 (or arc 354) adjacent to origin 358, programmed processor 132 (FIGS. 2–4) sequentially determines whether each segment or arc is intersected by a line extending orthogonally thereto that includes a point (e.g., 360 or 360') to be converted.

Referring now to FIG. 6B, a first portion of the algorithm for determining the station and offset values relative to a segment section is schematically illustrated. Programmed processor 132 first defines vectors 372 and 374. Vector 372 includes a tail at the starting point 381 of the segment and a head at the ending point 383 of the segment. Vector 374 includes a tail at starting point 381 and a head at point 360. Programmed processor 132 then determines the location of a point 382 by calculating the component of vector 374 that lies along vector 372 using known vector geometry techniques. If point 382 lies within the length of vector 374 (as shown in FIG. 6B) then programmed processor 132 calculates the station and offset values of point 360, otherwise it continues to the next segment or arc. As illustrated in FIG. 6B, the station value for point 360 is the sum of lengths 365 and 373 and the offset value is the magnitude of vector 376. These may be readily calculated using known vector calculus techniques. For example, the offset value for point 360, may be expressed according to equation (1) wherein v372, v374, and v376 refer to vectors 372, 374, and 376, respectively.

$$offset \equiv |v376| = |v374|\left(inv\cos\frac{[v374 \cdot v372]}{|v374||v372|}\right) \tag{1}$$

Referring now to FIG. 6C, a second portion of the algorithm for determining the station and offset values relative to an arc section is schematically illustrated. Programmed processor 132 first defines area 390, by extending a first line 392 through arc radius point 365 and arc starting point 383 to the site edges, and a second line 394 through arc radius point 365 and arc ending point 385 to the site edges. Area 390 is the area bounded by lines 392 and 394 as shown. If the point of interest (e.g., point 360') is located within area 390, programmed processor 132 calculates station and offset values, otherwise it continues to the next segment or arc. As shown, the station value for point 360' is the sum of lengths 375 and 377. The offset value is the length 379, which may be expressed mathematically as the difference between the length of the segment between radius point 365 and point 360', and the radius r of the arc.

Figure 7:
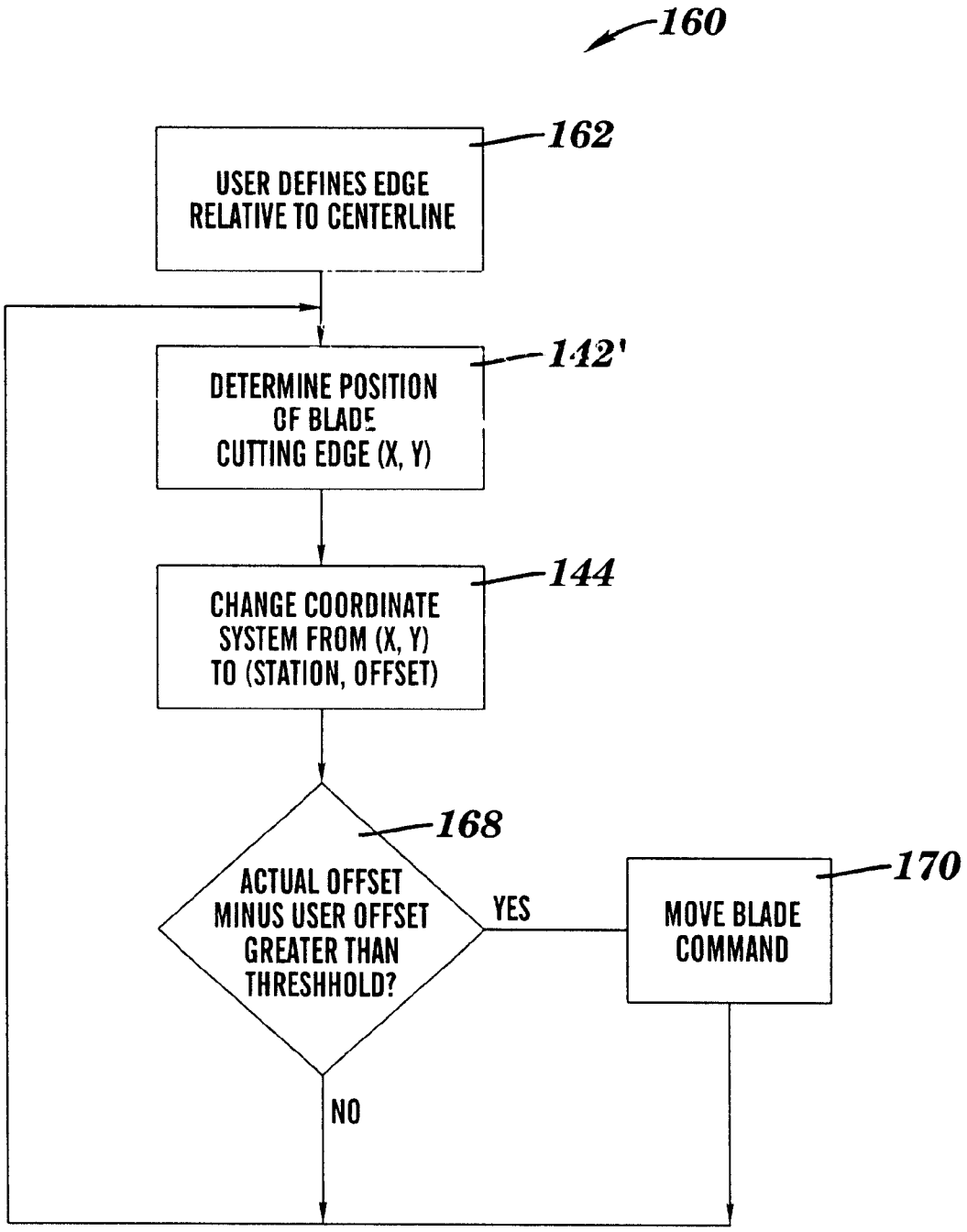
FIG. 7 is a flow chart representation of one embodiment of the cut-edge module of FIG. 3 and FIG. 4.

Referring to FIG. 7, a method of the present invention for cutting an edge in real time is implemented by cut-edge module 160 as is now described in greater detail. Cut-edge module 160 is particularly useful for road construction and other applications in which an edge to be cut or filled may be readily defined relative to a centerline. At block 162 a user defines an edge-offset (to be cut or filled) relative to a predefined centerline (described above). For example, in one embodiment, system 100' prompts a user to input an offset value. As an earth-working vehicle traverses a site, the position of a transverse cutting edge of blade 52' is determined 142' at predetermined intervals by three-dimensional positioning system 105. The position is typically determined 142' by a GPS-based method, as described above with respect to block 142. At block 144, the horizontal components of the local position determined at block 142' is converted from Cartesian coordinates to a centerline coordinate system (station, offset), for example as described hereinabove with respect to FIGS. 6A–6C. At block 168, the converted position (also referred to as 'reference offset') calculated at block 144 is compared to the user defined offset (from block 162). In the event the difference between the two values is greater than a predetermined threshold, cut-edge module 160 sends instructions at block 170 to controller 120 to adjust the lateral position of blade 52' relative to the machine 50 (FIGS. 3 and 4). Otherwise, the lateral position of the blade 52' remains unchanged and cut-edge module 160 loops back to block 142'.

Figure 8A:
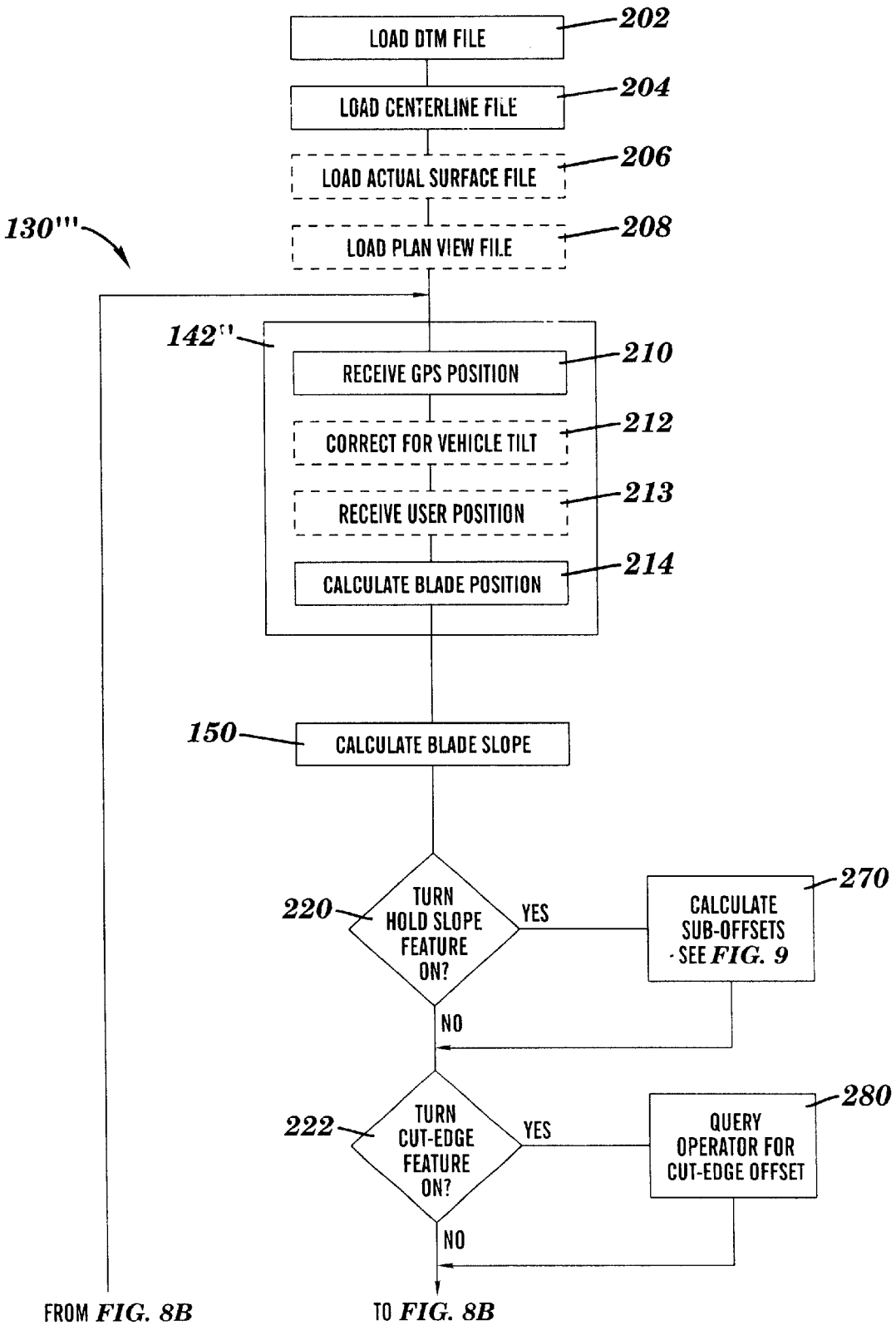
FIGS. 8A and 8B are a flow chart representation of another embodiment of the present invention.
Figure 8B:
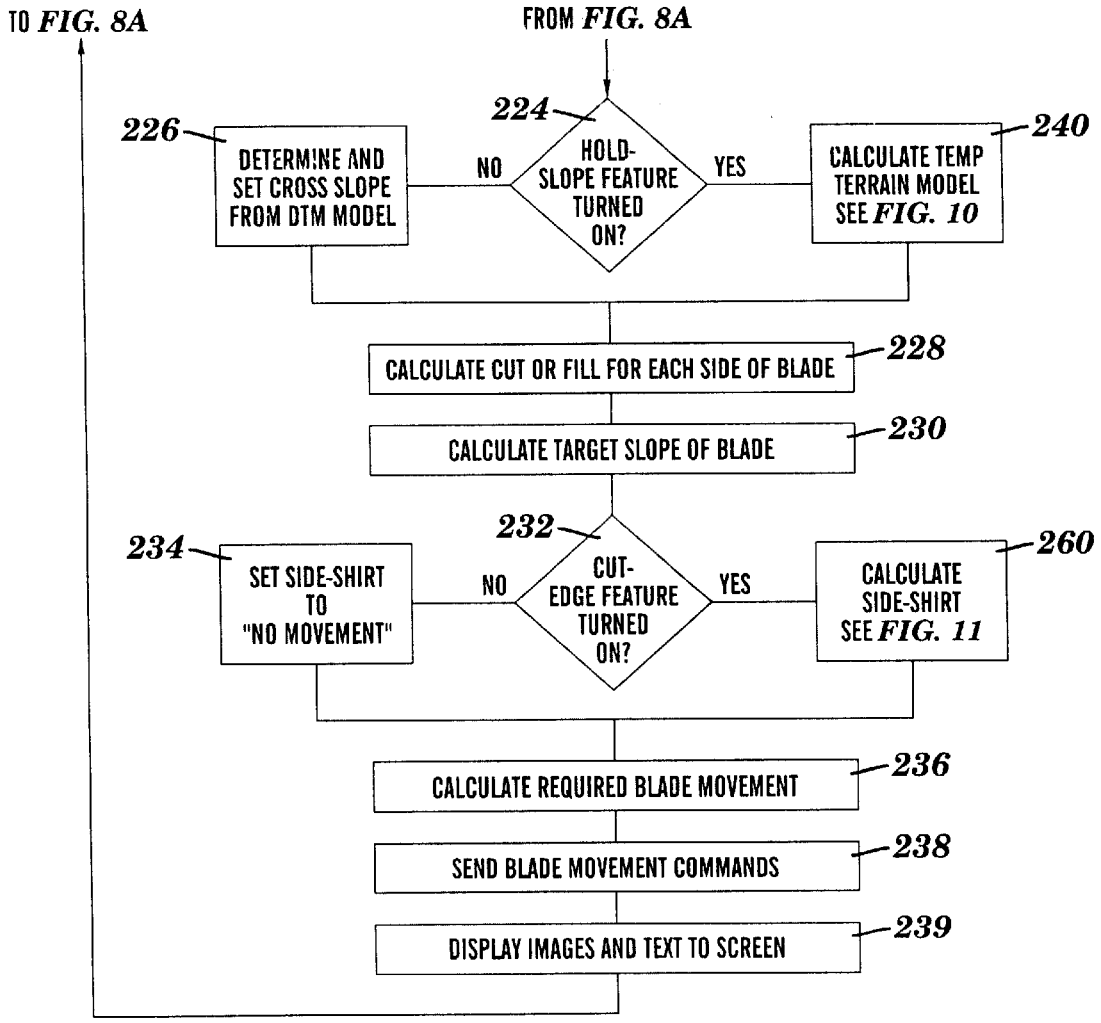

Referring to FIGS. 8A and 8B, an alternate embodiment of the system module portion of the present invention is shown at 130'''. Referring initially to FIG. 8A, a DTM model, including an array of coordinate points defining a desired site topography, may be loaded 202 into the memory of programmed processor 132 (FIGS. 2–4). A centerline file of the desired topology of the work site is loaded at block 204. In an alternate embodiment, a model of the actual surface site may be loaded as shown in phantom at block 206. This actual surface model may have been previously generated by conventional survey methodology, or, in the alternative, may be generated and updated in real time during earth-moving operations using the method disclosed in the '732 patent. As a further option also shown in phantom, a plan view file of the desired topology may also be loaded 208.

Upon loading the DTM and centerline files (and optionally the actual surface model and plan view files shown in phantom in FIG. 8A) into programmed processor 132 at blocks 202, 204, 206 and 208, the earth-working vehicle 50 may begin traversing the work site. As described hereinabove the three dimensional position data provided at 110, sensor assembly 124, and/or laser sensor 114 (FIGS. 2–4) are provided to module 130''', where, as shown at 142'', the data are received 210, and optionally corrected 212 for tilt of the earth moving machine 50. This positional data, in the event it relates specifically to the machine 50, may then be used to calculate the position 214, including slope 150, of the blade 52'.

In an alternate embodiment, two or more GPS antennae 108 may be positioned, for example, on opposite ends 56 of, the blade 52'. Such multiple antennae 108 may be used to provide three dimensional position data at multiple locations along blade 52', which may then be used to calculate the slope of the blade 52'. This use of multiple GPS antennae 108 may thus obviate the need for sensor assembly 124, or may advantageously be used as a redundancy check of the accuracy of sensor assembly 124.

At block 220, system module 130'' checks for an operator command to activate or deactivate the hold-slope feature. If an activation command is received, system module 130''' sets appropriate user-inputted values in block 270, which is described in further detail hereinbelow with respect to FIG. 9. If no command is received, system module 130''' proceeds to block 222 in which it checks for an operator command to activate the cut-edge feature. If an activation command is received, system module 130''' queries the vehicle operator for a cut-edge offset value at block 280. The term "cut-edge offset" as used herein shall refer to the distance (typically measured in feet) from the site centerline at which an edge is to be cut or filled. Upon receiving the query, the operator inputs the cut-edge offset value, typically using a keypad (not shown) associated with display 116 (FIGS. 2–4).

Referring now to FIG. 8B, system module 130''' checks the status of the hold-slope feature at block 224. If the hold-slope feature is activated, system module 130''' calculates a temporary terrain model at block 240, which is discussed in further detail hereinbelow with respect to FIG. 10. If the hold-slope feature is deactivated the design elevations at the blade edges 56 are determined from the DTM model at block 226 e.g., using GRADESTAR® blade control protocol (see GRADESTAR® Manual, version 1.42, dated Mar. 10, 1998, by Carlson Software, Inc., which is fully incorporated herein by reference). At block 228, system module 130''' calculates the amount of cut or fill required at either end 56 of the blade 52'. At block 230 system module 130''' calculates a target slope for blade 52'. At block 232, system module 130''' checks the status of the cut-edge feature. If the cut-edge feature is activated, the lateral distance required to move a transverse cutting edge of the blade 52' back to the user defined cut-edge offset from the centerline is calculated at block 260, which is discussed in further detail hereinbelow with respect to FIG. 11. If the cut-edge feature is deactivated, blade 52' is set for no lateral movement at block 234.

At block 236, system module 130''' calculates the necessary movement required by the hold-slope and cut-edge modules in order to update the position of blade 52'. Blade 52' movement commands are sent to controller 120 (FIGS. 2–4) at block 238. A more detailed discussion of block 238 and blade movement control in general is included hereinbelow with respect to FIG. 12. At block 239, system module 130''' updates the user display with the appropriate graphical and textual information. Exemplary screen displays are discussed in more detail hereinbelow with respect to FIGS. 13 and 14.

Figure 9:
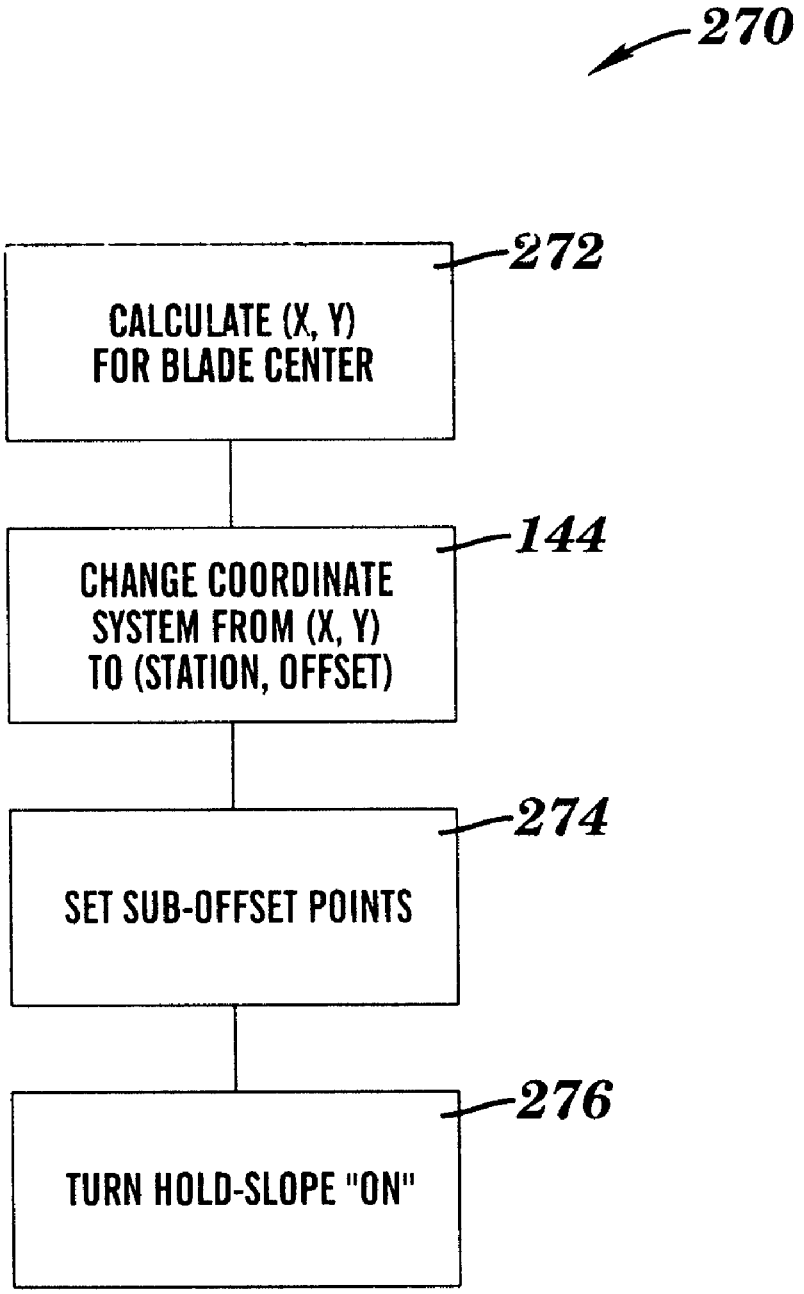
FIG. 9 is a flow chart representation of one portion of the embodiment shown in FIGS. 8A and 8B.

Referring to FIG. 9, of block 270 (FIG. 8A), in which system module 130''' calculates the sub-offset values required by the hold-slope feature, is described in greater detail. At block 272, system module 130''' calculates the position (in x, y coordinates) for the center of blade 52'. In one embodiment, in which blade 52' includes a GPS antenna at one end 56, the GPS position received at block 210 (FIG. 8A) and the blade orientation calculated at block 214 (FIG. 8A) are used, along with mathematical techniques well known to those skilled in the art, to calculate the blade center position. (In an alternate embodiment described hereinabove, in which GPS antenna are positioned at both ends 56 of blade 52', the blade center position is determined by averaging the two GPS positions received at block 210.) At block 144, the position calculated at 272 is converted from Cartesian coordinates (x, y) to a centerline coordinate system (station, offset), for example as described hereinabove with respect to FIGS. 6A–6C. At block 274, two sub-offset values (sub-offset1 and sub-offset 2) are determined for the station, offset coordinate calculated in block 144. Sub-offset 1 and sub-offset2 are new offset values that are used to calculate the hold-slope and are typically determined by adding and subtracting, respectively, a constant to the offset value calculated at block 144'. For example, in one embodiment, sub-offset1 is equal to the offset coordinate value calculated at block 144 plus six inches, while sub-offset 2 is equal to the offset coordinate value calculated at block 144 minus six inches. At block 276 the hold-slope feature is activated.

Figure 10:
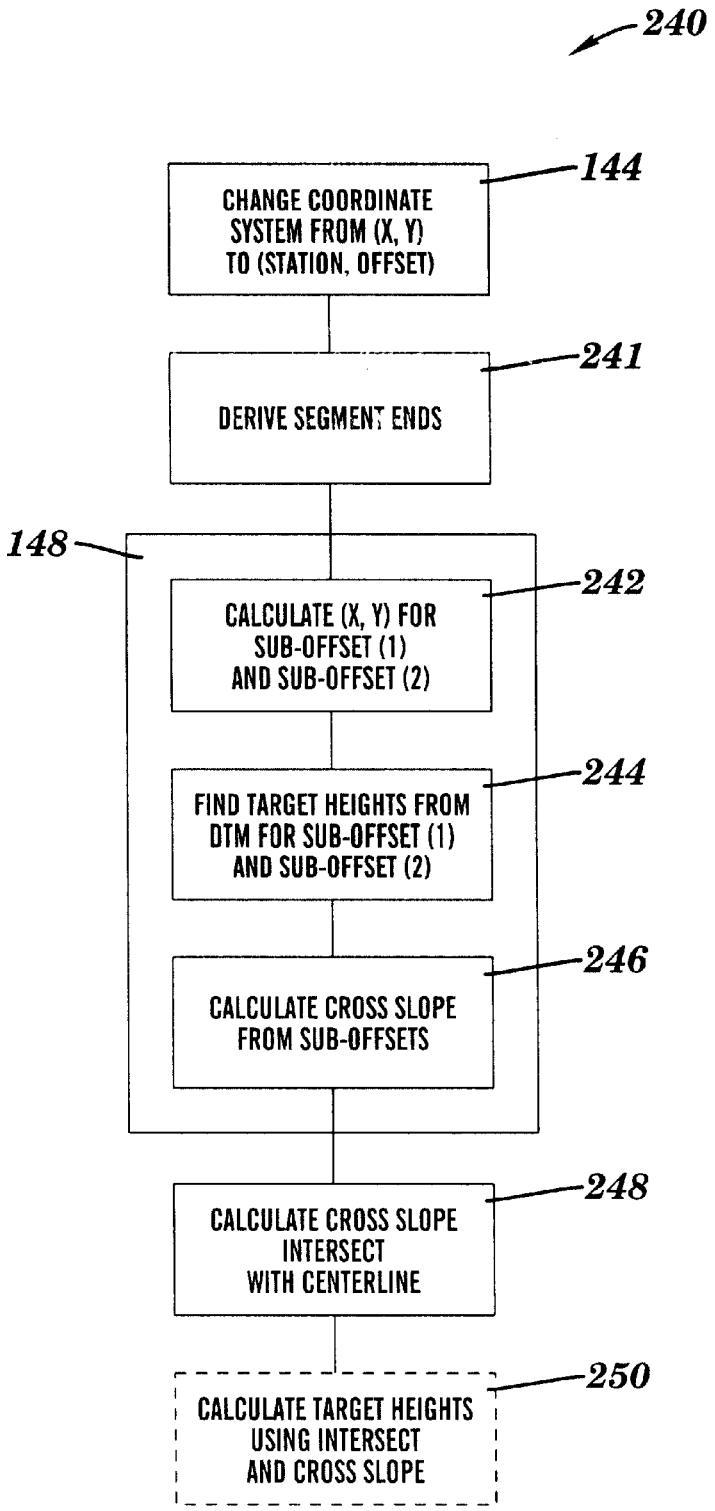
FIG. 10 is a flow chart representation of another portion of the embodiment shown in FIGS. 8A and 8B.

Referring now to FIG. 10, more detail is provided regarding block 240 (of FIG. 8B) in which system module 130''' calculates the temporary terrain model used for determining the cross slope. At block 144, the horizontal components of the position calculated at block 214 (of FIG. 8A) are converted from Cartesian coordinates (x, y) to a centerline coordinate system (station, offset), for example as described above with respect to FIGS. 6A–6C. At 241, a segment is defined having end points (station, sub-offset 1) and (station, sub-offset2). (The sub-offset1 and sub-offset2 values may be retrieved from block 274 in FIG. 9.) The slope of the sub-offset segment is calculated 148 using blocks 242, 244, and 256. At block 242, the end points are converted from centerline coordinates back to Cartesian coordinates (x, y). At block 244 a DTM model is used to find target heights (z dimension) for the two end points. The slope of the segment defined by the two endpoints is then calculated at block 246 using conventional mathematical techniques. The slope calculated at block 246 is defined as a temporary terrain model and may be extended beyond the user defined offset, e.g., to the plan edges. As described above, the use of a temporary terrain model is advantageous in that it allows an operator to move a portion of the blade 52' across one or more boundary lines (e.g., the centerline or other lines defining a change in slope) while maintaining the cross slope calculated at block 246. At block 248, system module 130''' determines an intersection point between the temporary terrain model defined above and the centerline. System module 130''' may use this intersection point and the calculated cross slopes to calculate target heights for the ends 56 of blade 52' along the longitudinal cutting edge.

Figure 11:
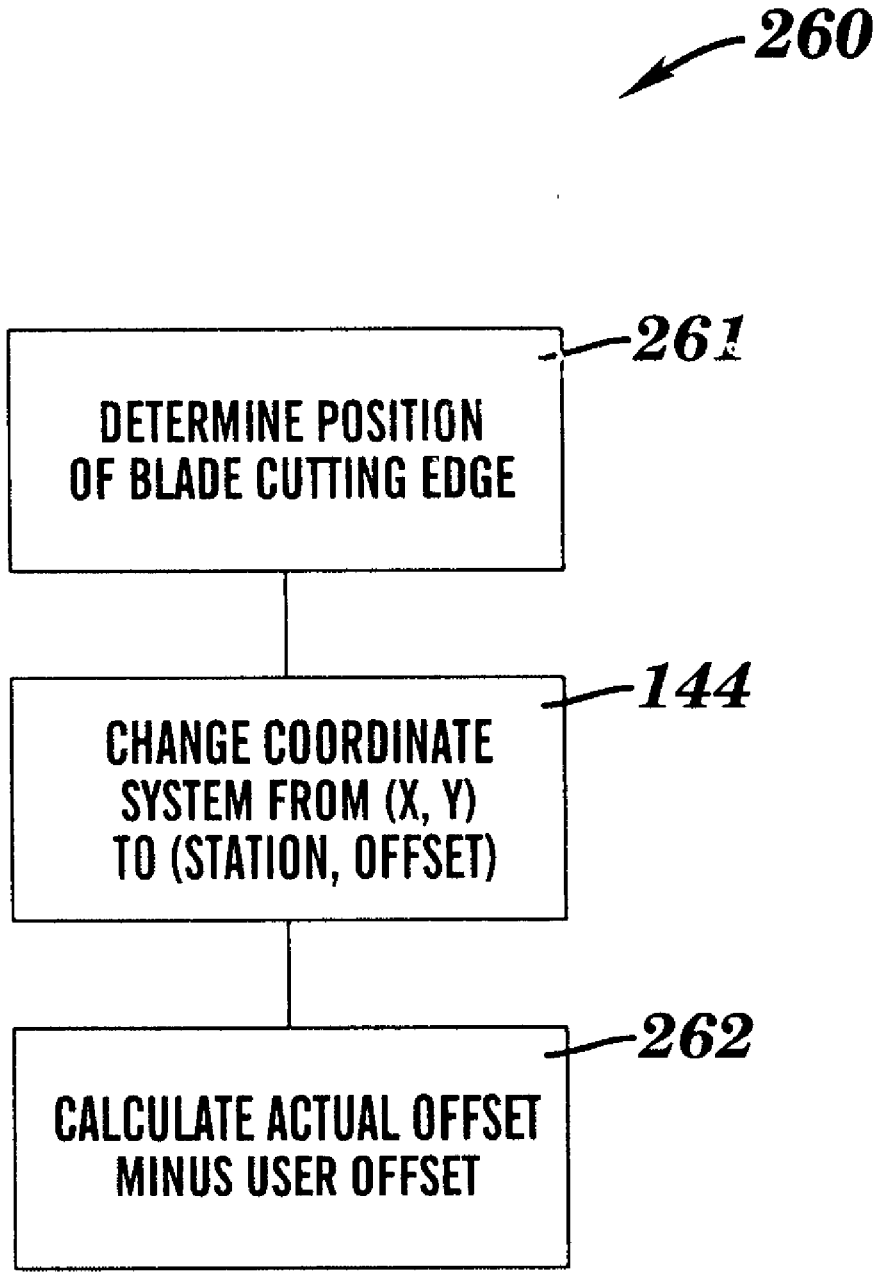
FIG. 11 is a flow chart representation of yet another portion of the embodiment shown in FIGS. 8A and 8B.

Referring now to FIG. 11, more detail is provided regarding block 260 (of FIG. 8B) in which system module 130''' calculates the side shift (lateral movement) required by the cut-edge module. As described hereinabove with respect to FIG. 7, the position of a transverse cutting edge of blade 52' is determined 142'. At block 144, the position determined at block 261 is converted from Cartesian coordinates (x, y) to a centerline coordinate system (station, offset), for example as described above with respect to FIGS. 6A–6C. At block 262, system module 130''' calculates the difference between the reference offset determined in block 144 and the user defined offset set in block 280 (FIG. 8A). The control assembly 126 may then shift the blade 52' laterally by the amount of this calculated difference as discussed hereinbelow.

Figure 12:
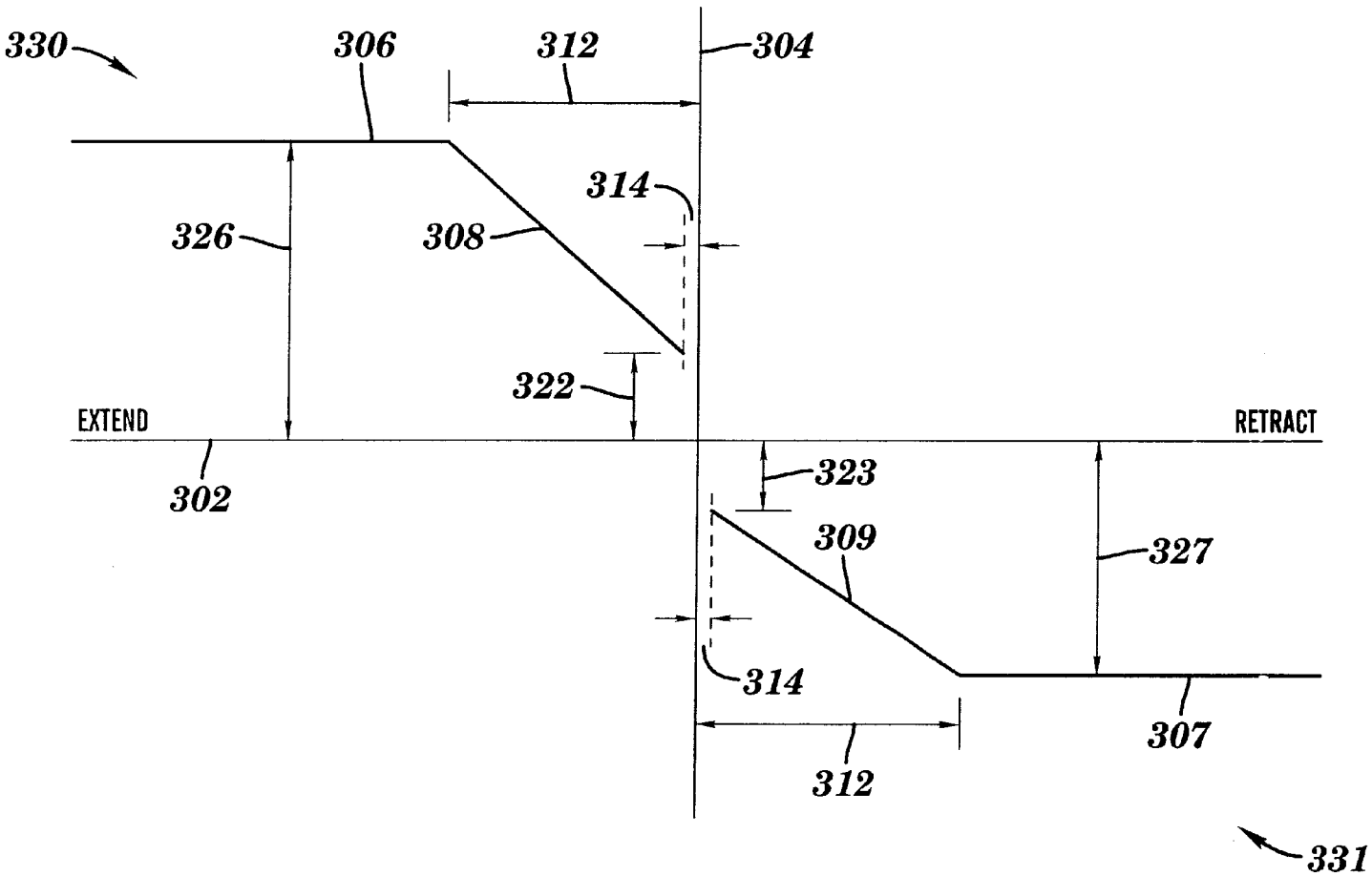
FIG. 12 is a graphical representation of one embodiment of blade movement commands used by the embodiment shown in FIGS. 8A and 8B.

Referring now to FIG. 12, more detail is provided regarding one embodiment of block 238 (FIG. 8B) in which system module 130''' (FIGS. 8A and 8B) sends blade movement commands to controller 120 (FIGS. 2–4). Since system module 130''' provides for precise horizontal and vertical control of blade 52' (e.g., within 0.1 inch), precise control of the velocity at which the blade 52' is moved tends to be desirable. Blade 52' is typically positioned by controlling the extension and/or retraction of a plurality of (e.g., three or more) hydraulic cylinders. FIG. 12 schematically plots the velocity at which hydraulic fluid is pumped into (at 330) or out of (at 331) a single cylinder on the ordinate axis 304 versus the distance that the blade (or blade edge 56) needs to be moved (extended or retracted) on the abscissa axis 302. The relative velocity at which hydraulic fluid is pumped typically determines the velocity at which a cylinder extends or retracts and therefore tends to determine the velocity at which the blade 52' is moved. The blade movement commands for cylinder extension and retraction are similar (although not identical as described below) and are therefore discussed in unison. Blade movement commands requiring cylinder extension (e.g., moving the blade 52' down) are shown at 330 while those requiring cylinder retraction (e.g., moving the blade 52' up) are shown at 331. For distances less than a minimum threshold 314 (e.g., 0.1 inch), blade movement is not required, and therefore, system module 130''' instructs controller 120 to leave the blade position unchanged. For distances greater than minimum threshold 314 but less than an intermediate threshold 312, system module 130''' instructs controller 120 to pump hydraulic fluid (either into or out of the cylinder) at a velocity that is a linear function 308, 309 of the required blade movement. For blade movements greater than intermediate threshold 312, system module 130''' instructs controller 120 to pump hydraulic fluid at a constant maximum velocity, as shown at 306 and 307, for cylinder extension and retraction, respectively. A typical hydraulic cylinder requires less fluid to retract a given distance than to extend the same distance. As a result, lower fluid velocities are required for cylinder retraction to achieve a given blade velocity. For example, in one embodiment, the maximum velocity 327 (for cylinder retraction) equals 75% of the maximum velocity 326 (for cylinder extension), while minimum velocity 323 (for retraction) equals 75% of minimum velocity 322 (for extension). The discussion hereinabove pertaining to FIG. 12 typically applies to a blade 52' that is moved by a plurality of hydraulic cylinders. The artisan of ordinary skill will readily recognized that the general principles thereof may be applied to other mechanisms of blade movement.

As described hereinabove, system module 130''' is typically connected to controller 120 by conventional wiring or cable (e.g., an RS232 serial connection). System module 130''' may further communicate the blade movement commands to controller 120 by any known protocol. In one exemplary embodiment, system module 130''' transmits ASCII characters to a translation box 118 (FIGS. 2–4) by an RS232 serial connection, in which each ASCII character corresponds to a unique fluid velocity. The translation box 118 converts the ASCII characters into a format recognizable by controller 120 and transmits them thereto.

Figure 13:
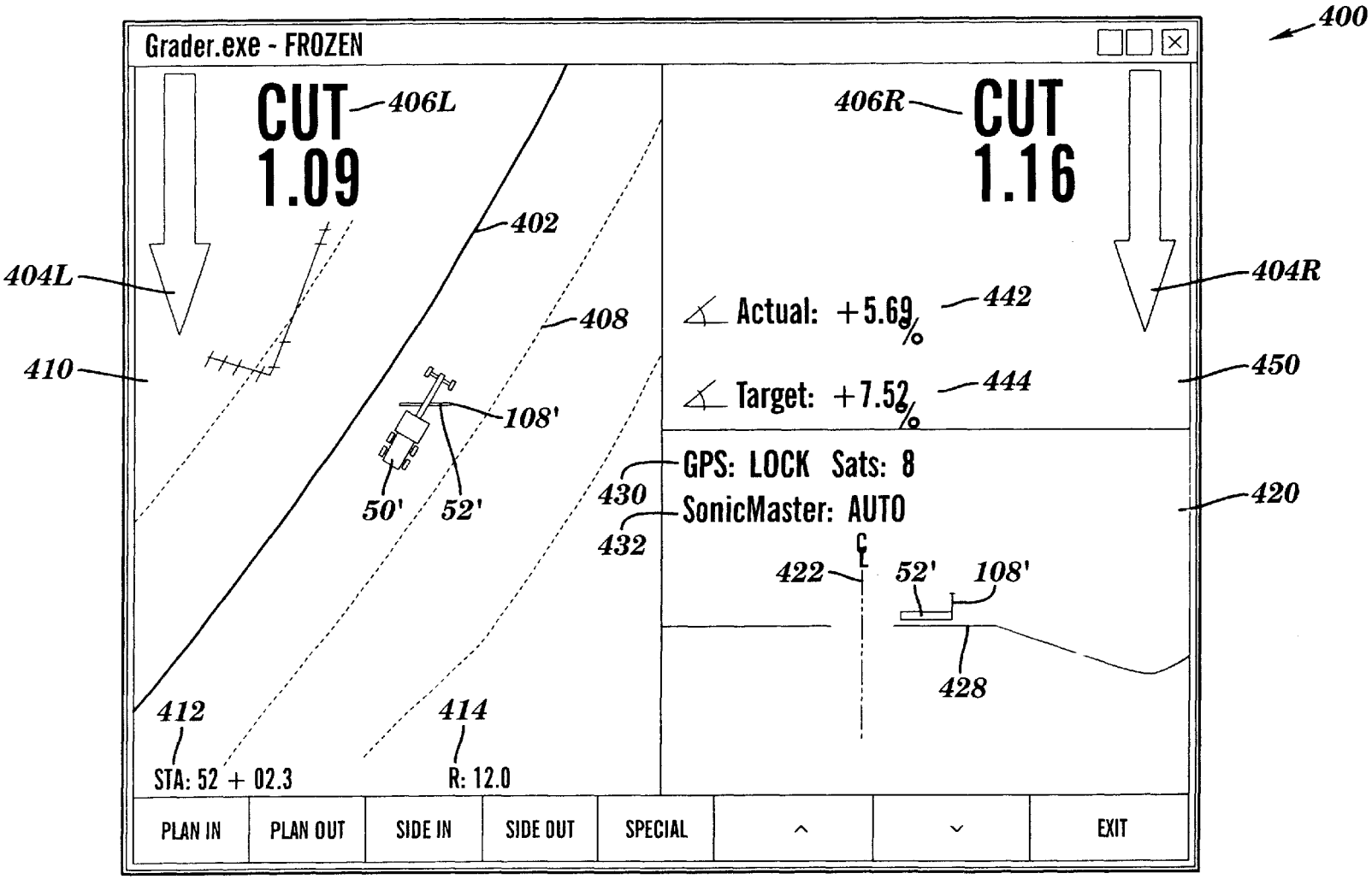
FIG. 13 is a screen display of one embodiment of multiple operator displays of the machinery position and control system provided by the embodiment of FIGS. 8A and 8B.

Referring now to FIG. 13, an exemplary graphical user interface (GUI) 400 of the present invention includes a real time display of a top plan view 410 of the vehicle 50' equipped with the system module 130''' (FIGS. 8A and 8B) of the present invention indicating the position of the vehicle 50' relative to a center line 402. Vehicle 50' is shown with a blade 52' and GPS antenna 108'. This display thus indicates the station and offset to the centerline 402. As also shown, alphanumeric indicia indicating the station from a predetermined point along center line 402 is shown at 412 and the offset is indicated alphanumerically at 414 with the prefix R or L indicating that the numerical offset is in the right-hand or left-hand directions relative to the forward direction of travel of the vehicle 50'. As shown, the indicia indicate a vehicle 50' positioned 5,202.3 feet along the centerline 402 from the origin (not shown) and 12 feet to the right of the centerline 402. Plan view 410 may also show one or more boundary lines 408, which indicate for example the location of a change in slope of the desired topography (e.g., the boundary between a road edge and a drainage ditch). The amount of cut or fill at the right-hand and left-hand sides 56 of blade 52' is shown in enlarged alphanumeric characters at 406R and 406L, respectively. The arrows 404R and 404L show the required direction of movement at the right-hand and left-hand sides 56 of the blade 52', respectively.

A cross-sectional elevational view taken along a vertical plane extending parallel to the longitudinal axis 52a of the blade 52' is shown at 420. In this view, blade 52' is shown at its actual location relative to a desired topography 428. The position of the centerline is shown as a vertical line at 422. This display further indicates the status of the three-dimensional positioning system 105, alphanumerically at 430. As shown, the GPS system is locked-in to a base receiver (e.g., base receiver 102 shown in FIGS. 2–4) and receiving positional data from eight satellites. The GPS status may also be shown as FLOAT or NONE, indicating that there is incomplete or no communication contact, respectively, with the base receiver. This display further indicates the status of controller 120 (FIGS. 2–4), alphanumerically at 432. As shown, the SonicMaster® controller 120 is set for automatic control of blade 52'. The controller 120 status may also be shown as MANUAL indicating that the operator may manually move blade 52', or NONE indicating that that controller 120 has lost communication contact with the blade 52'. The actual (i.e., as measured) and target (determined from the DTM data) slopes are shown in quadrant 450 in enlarged alphanumeric indicia as 442 and 444, respectively. The angle symbols at 442 and 444 indicate the direction of the slope.

Figure 14:
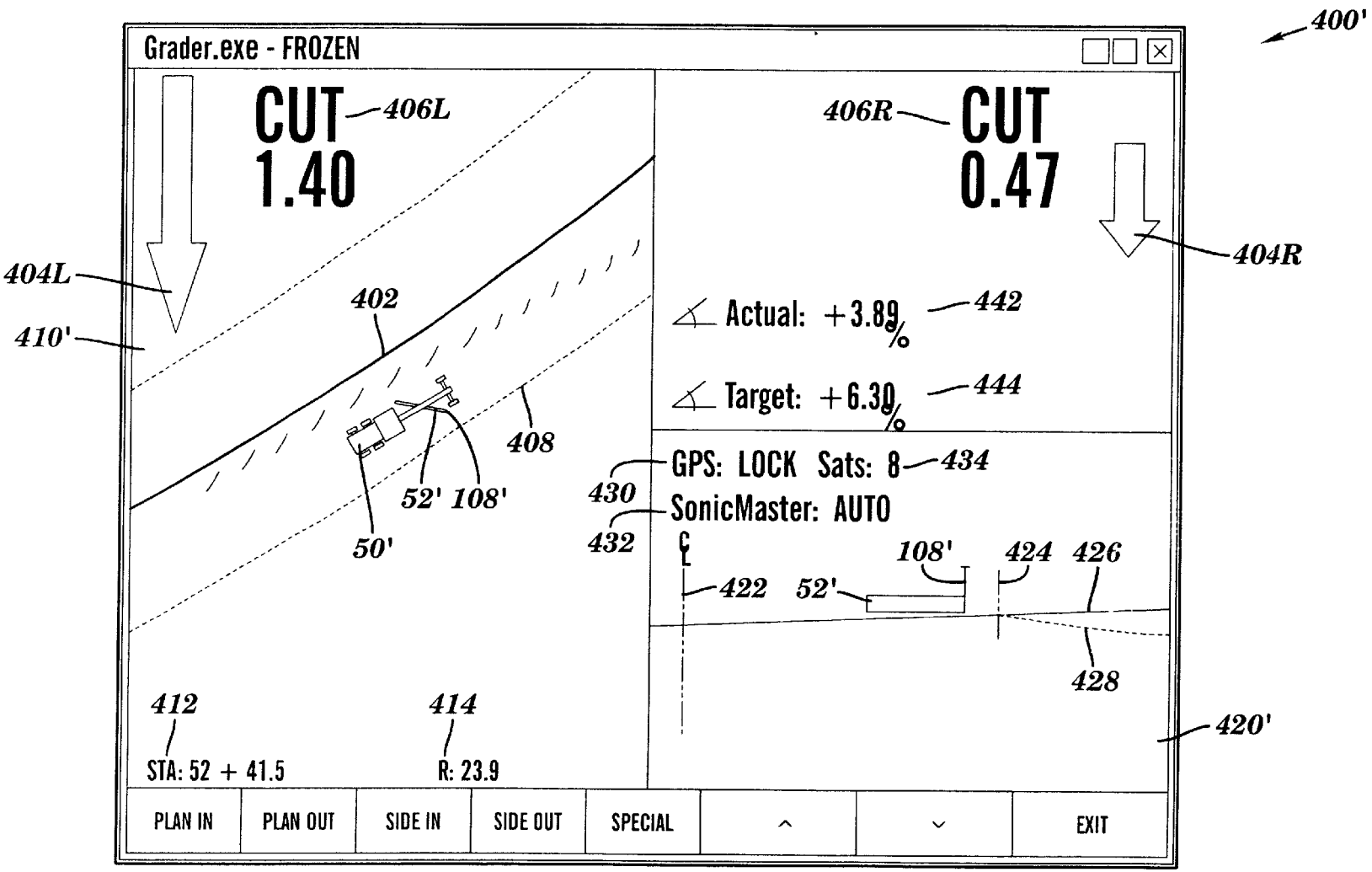
FIG. 14 is a screen display of another embodiment of multiple operator displays of the machinery position and control system provided by the embodiment of FIGS. 8A and 8B.

Turning now to FIG. 14, another exemplary GUI 400' associated with system module 130''' (FIGS. 8A and 8B) includes a plan view 410' substantially similar to that shown in FIG. 13, including a vehicle 50' shown in relation to a centerline 402. Cross-sectional elevational view 420' is also similar to that described above with respect to FIG. 13, however, it shows elements indicating that the hold-slope and cut-edge features have been activated. View 420' includes a vertical line 424 at the user defined offset at which an edge is to be cut (or filled). View 420' also includes a sloped line 426 overlaying the desired topography 428 described hereinabove, the sloped line 426 being the temporary terrain model (i.e., the slope at which the blade 52' is held independent of its offset to the centerline).

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defined by the accompanying claims.

What is claimed is:

1. A method for controlling in real time the position of a blade on a geography altering machine, said method comprising:

providing a geography altering machine, including a blade and a computer, the computer having stored therein a reference line and a three dimensional computer model of a desired topography of a work site;

providing a user defined offset relative to said reference line;

determining a blade position in local coordinates;

converting said local coordinates to reference line coordinates, said reference line coordinates including a reference station value and a reference offset value;

calculating a slope along a segment orthogonal to said reference line at said reference station and extending said slope beyond said user defined offset, defining a temporary design surface; and moving said blade so that the actual cross slope of said blade is substantially equal to the slope of said temporary design surface.

2. The method of claim 1 wherein said geography altering machine further comprises a GPS receiver system including a GPS signal-receiving antenna disposed on an end of said blade.

3. The method of claim 1 wherein said geography altering machine further comprises a GPS receiver system including a plurality of GPS signal-receiving antennae, disposed on a plurality of ends of said blade.

4. The method of claim 1 wherein said geography altering machine further includes a laser sensor mounted on an end of said blade.

5. The method of claim 1 wherein said geography altering machine is a motor grader.

6. The method of claim 1 wherein said geography altering machine is a bulldozer.

7. The method of claim 1 wherein said computer further includes a three-dimensional model of an actual topography stored therein.

8. The method of claim 1 wherein said computer further includes a plan view file stored therein.

9. The method of claim 1 wherein said providing a user defined offset value comprises an operator inputting said offset value by a computer keypad.

10. The method of claim 1 wherein said providing a user defined offset value comprises:

receiving a GPS signal at a GPS signal-receiving antenna coupled to said geography altering machine and utilizing the GPS signal to calculate a position of said antenna in local coordinates;

converting said local coordinates to reference line coordinates, including a reference station and a reference offset value; and defining said user defined offset value to be substantially equal to said reference offset value.

11. The method of claim 1 wherein said determining a position comprises receiving a GPS signal at a GPS signal-receiving antenna coupled to said geography altering machine and utilizing the GPS signal to calculate a location of said antenna in at least two dimensions.

12. The method of claim 11 wherein said determining a position further comprises utilizing one or more tilt sensors to provide an angle of tilt of said geography altering machine along at least one axis and utilizing the angle of tilt to calculate the location of said antenna.

13. The method of claim 11 wherein said determining a position further comprises utilizing a laser sensor to determine a third dimension.

14. The method of claim 1 wherein said determining a position comprises calculating the center position of said blade.

15. The method of claim 1 wherein said local coordinates comprise Cartesian coordinates.

16. The method of claim 1 wherein said converting comprises dividing said reference line into a series of segments and arcs.

17. The method of claim 1 wherein said converting comprises utilizing vector mathematics techniques.

18. The method of claim 1 wherein said calculating further comprises utilizing said three-dimensional computer model of a desired topography.

19. The method of claim 1 wherein said segment further comprises said user defined offset as a center point.

20. The method of claim 1 wherein said calculating further comprises:

converting the endpoints of said segment from reference line coordinates to Cartesian coordinates;

using said three-dimensional computer model of a desired topography to determine target heights for said endpoints; and calculating the slope of said segment.

21. The method of claim 1 wherein said moving comprises selectively extending and retracting hydraulic cylinders.

22. The method of claim 1 wherein blade movement commands, comprising hydraulic fluid pumping velocity instructions, are sent to a blade controller.

23. The method of claim 1 wherein blade movement commands are sent to a blade controller by transmitting ASCII characters thereto; each of said ASCII characters corresponding to a unique hydraulic fluid pumping velocity.

24. The method of claim 1 further comprising displaying the position of said blade relative to said work site.

25. The method of claim 24 wherein said position is displayed relative to said reference line.

26. The method of claim 24 wherein said displaying the position of said blade relative to said work site includes displaying a member of the group consisting of:

a top plan view including the current position of said machine and said blade;

a cross sectional elevational view including a vertical line representing the reference line, and the actual position of said blade taken along a plane parallel to the longitudinal axis of said blade;

and numeric indicia representing said station and offset values.

27. The method of claim 26 wherein said top plan view further includes a reference line.

28. The method of claim 26 wherein said top plan view further includes features of said desired topography.

29. The method of claim 26 wherein said cross sectional elevational view further includes a vertical line representing a user defined offset at which an edge may be selectively cut and filled.

30. The method of claim 26 wherein said displaying the position of said blade relative to said work site includes simultaneously displaying two or more members of the group consisting of:

a top plan view including the current position of said machine and said blade;

a cross sectional elevational view including a vertical line representing the reference line, and the actual position of said blade taken along a plane parallel to the longitudinal axis of said blade; and numeric indicia representing said station and offset values.

31. The method of claim 1 further comprising displaying a cross slope of said blade to an operator of said machine.

32. The method of claim 31 wherein said displaying the cross slope of said blade is selected from the group consisting of:

displaying a cross sectional elevational view including a vertical line representing the reference line, and the actual position of said blade taken along a plane parallel to the longitudinal axis of said blade; and displaying numeric indicia representing the values of the actual and target cross slopes.

33. The method of claim 32 wherein the direction of the cross slope is displayed by an angle symbol proximate said numeric indicia.

34. The method of claim 31 wherein said displaying the cross slope of said blade comprises simultaneously:

displaying a cross sectional elevational view including a vertical line representing the reference line, and the actual position of said blade taken along a plane parallel to the longitudinal axis of said blade; and displaying numeric indicia representing the values of the actual and target cross slopes.

35. The method of claim 1 wherein the amount of selective cut and fill at the left-hand and right-hand ends of said blade are displayed by enlarged alphanumeric indicia, the indicia being disposed in the upper left-hand and upper right-hand corners of the display to indicate the cut and fill at the respective left-hand and right-hand ends of said blade.

36. The method of claim 1 wherein:

said calculating further comprises comparing said reference offset to said user defined offset; and said moving further comprises moving said blade to a position wherein said reference offset is substantially equal to said user defined offset.

37. An article of manufacture for controlling in real time the position of a blade on a geography altering machine, said article of manufacturing comprising:

a computer usable medium having a computer readable program code embodied therein, said computer usable medium including:

computer readable program code for prompting a user for a user defined offset relative to a reference line;

computer readable program code for determining a blade position in local coordinates;

computer readable program code for converting said local coordinates to reference line coordinates, including reference station and reference offset values;

computer readable program code for calculating a slope along a segment orthogonal to said reference line at said reference station and extending said slope beyond said user defined offset, defining a temporary design surface; and computer readable program code for sending blade movement commands to a blade controller for moving the blade so that the actual cross slope is substantially equal to the slope of said temporary design surface.

38. The article of manufacture of claim 37 wherein the computer usable medium further comprises:

computer readable program code for comparing said user defined offset to said reference offset; and computer readable program code for sending blade movement commands to a blade controller for moving the blade to a position wherein said reference offset is substantially equal to said user defined offset.

39. The article of manufacture of claim 37 wherein the computer usable medium further comprises computer readable program code for utilizing a GPS signal to calculate the blade position in Cartesian coordinates.

40. The earth-working machine of claim 34 wherein said computer is further configured to compare said user defined offset to said reference offset; and send blade movement commands to said blade controller for moving said blade to a position wherein the reference offset is substantially equal to the user defined offset.

41. The article of manufacture of claim 37 wherein the computer usable medium further comprises computer readable program code for utilizing a GPS signal and an angle of tilt acquired from one or more tilt sensors to calculate the blade position in Cartesian coordinates.

42. The article of manufacture of claim 37 wherein the computer usable medium further comprises computer readable program code for:

converting the endpoints of said segment from reference line coordinates to Cartesian coordinates;

using said three-dimensional computer model of a desired topography to determine target heights for said endpoints; and calculating the slope of said segment.

43. The article of manufacturing of claim 37 wherein the computer usable medium further comprises computer readable program code for transmitting blade movement commands to a blade controller by transmitting ASCII characters thereto, each of said ASCII characters corresponding to a unique hydraulic fluid pumping velocity.

44. The article of manufacturing of claim 37 wherein the computer usable medium further comprises computer readable program code for:

displaying the position of said blade relative to said reference line; and displaying a cross slope of said blade.

45. An earth-working machine comprising:

a blade;

a blade controller configured for moving said blade;

a computer having stored therein a reference line and a three dimensional computer model of a desired topography;

said computer being configured to prompt a user for a user defined offset relative to a reference line, determine a blade position in local coordinates, convert said local coordinates to reference line coordinates, including reference station and reference offset values, calculate a slope along a segment orthogonal to said reference line at said reference station and extend said slope beyond said user defined offset, defining a temporary design surface, and send blade movement commands to said blade controller for moving said blade so that the actual cross slope of said blade is substantially equal to the slope of said temporary design surface.

46. A method for controlling in real time the position of a blade on a geography altering machine, said method comprising:

providing a geography altering machine, including a blade and a computer, the computer having stored therein a reference line for a work site;

providing a user defined offset value relative to said reference line;

determining a blade position in local coordinates;

converting said local coordinates to reference line coordinates, said reference line coordinates including a reference station value and a reference offset value;

comparing said user defined offset to said reference offset; and moving said blade in a lateral direction relative to the geography altering machine to a position wherein said reference offset is substantially equal to said user defined offset.

47. The method of claim 46 wherein said geography altering machine further comprises a GPS receiver system including a GPS signal-receiving antenna disposed on one end of said blade.

48. The method of claim 46 wherein said geography altering machine further comprises a GPS receiver system including two GPS signal-receiving antenna, one disposed on each end of said blade.

49. The method of claim 46 wherein said geography altering machine further includes a laser sensor mounted on one end of said blade.

50. The method of claim 46 wherein said geography altering machine is a motor grader.

51. The method of claim 46 wherein said geography altering machine is a bulldozer.

52. The method of claim 46 wherein said computer further includes a three-dimensional model of an actual topography stored therein.

53. The method of claim 46 wherein said computer further includes a three-dimensional model of a desired topography stored therein.

54. The method of claim 46 wherein said computer further includes a plan view file stored therein.

55. The method of claim 46 wherein said providing a user defined offset value comprises an operator inputting said offset value by a computer keypad.

56. The method of claim 46 wherein said providing a user defined offset value comprises:

receiving a GPS signal at a GPS signal-receiving antenna coupled to said geography altering machine and utilizing the GPS signal to calculate a position of said antenna in local coordinates;

converting said local coordinates to reference line coordinates, including a reference station and a reference offset value; and defining said user defined offset value to be substantially equal to said reference offset value.

57. The method of claim 46 wherein said determining a position comprises receiving a GPS signal at a GPS signal-receiving antenna coupled to said geography altering machine and utilizing the GPS signal to calculate a location of said antenna in at least two dimensions.

58. The method of claim 46 wherein said determining a position further comprises utilizing one or more tilt sensors to provide an angle of tilt of said geography altering machine along at least one axis and utilizing the angle of tilt to calculate the location of said antenna.

59. The method of claim 46 wherein said local coordinates comprise Cartesian coordinates.

60. The method of claim 46 wherein said converting comprises dividing said reference line into a series of segments and arcs.

61. The method of claim 46 wherein said converting comprises utilizing vector mathematics techniques.

62. The method of claim 46 wherein said moving comprises selectively extending and retracting hydraulic cylinders.

63. The method of claim 46 wherein blade movement commands, comprising hydraulic fluid pumping velocity instructions, are sent to a blade controller.

64. The method of claim 46 wherein blade movement commands are sent to a blade controller by transmitting ASCII characters thereto; each of said ASCII characters corresponding to a unique hydraulic fluid pumping velocity.

65. The method of claim 46 further comprising displaying the position of said blade relative to said work site.

66. The method of claim 65 wherein said displaying the position of said blade relative to said work site includes displaying a member of the group consisting of:

a top plan view including the current position of said machine and said blade;

a cross sectional elevational view including a vertical line representing the reference line, and the actual position of said blade taken along a plane parallel to the longitudinal axis of said blade; and numeric indicia representing said station and offset values.

67. The method of claim 66 wherein said top plan view further includes a reference line.

68. The method of claim 66 wherein said top plan view further includes features of said work site.

69. The method of claim 66 wherein said cross sectional elevational view further includes a vertical line representing a user defined offset at which an edge may be selectively cut and filled.

70. The method of claim 65 wherein said displaying the position of said blade relative to said work site includes simultaneously displaying two or more members of the group consisting of:

a top plan view including the current position of said machine and said blade;

a cross sectional elevational view including a vertical line representing the reference line, and the actual position of said blade taken along a plane parallel to the longitudinal axis of said blade; and numeric indicia representing said station and offset values.

71. The method of claim 46 further comprising displaying a cross slope of said blade.

72. The method of claim 71 wherein said displaying the cross slope of said blade is selected from the group consisting of:

displaying a cross sectional elevational view including a vertical line representing the reference line, and the actual position of said blade taken along a plane parallel to the longitudinal axis of said blade; and displaying numeric indicia representing the values of the actual and target cross slopes.

73. The method of claim 71 wherein the direction of the cross slope is displayed by an angle symbol proximate said numeric indicia.

74. The method of claim 71 wherein said displaying the cross slope of said blade includes simultaneously:

displaying a cross sectional elevational view including a vertical line representing the reference line, and the actual position of said blade taken along a plane parallel to the longitudinal axis of said blade; and displaying numeric indicia representing the values of the actual and target cross slopes.

75. The method of claim 46 wherein the amount of selective cut and fill at the left-hand and right-hand ends of said blade are displayed by enlarged alphanumeric indicia, the indicia being disposed in the upper left-hand and upper right-hand corners of the display to indicate the cut and fill at the respective left-hand and right-hand ends of said blade.

76. The method of claim 46 further comprising calculating a slope along a segment orthogonal to said reference line at said reference station and extending said slope beyond said user defined offset, defining a temporary design surface.

77. The method of claim 76 wherein said moving further comprises moving said blade so that the actual cross slope of said blade is substantially equal to the slope of said temporary design surface.

78. An article of manufacture for controlling in real time the position of a blade on a geography altering machine, said article of manufacturing comprising:

a computer usable medium having a computer readable program code embodied therein, said computer usable medium including:

computer readable program code for prompting a user for a user defined offset relative to a reference line;

computer readable program code for determining a blade position in local coordinates;

computer readable program code for converting said local coordinates to reference line coordinates, including reference station and reference offset values;

computer readable program code for comparing said user defined offset to said reference offset; and computer readable program code for sending blade movement commands to a blade controller.

79. The article of manufacture of claim 78 wherein the computer usable medium further comprises computer readable program code for utilizing a GPS signal to calculate the blade position in Cartesian coordinates.

80. The article of manufacture of claim 78 wherein the computer usable medium further comprises computer readable program code for utilizing a GPS signal and an angle of tilt acquired from one or more tilt sensors to calculate the blade position in Cartesian coordinates.

81. The article of manufacturing of claim 78 wherein the computer usable medium further comprises computer readable program code for transmitting blade movement commands to a blade controller by transmitting ASCII characters thereto, each of said ASCII characters corresponding to a unique hydraulic fluid pumping velocity.

82. The article of manufacturing of claim 78 wherein the computer usable medium further comprises computer readable program code for:

displaying the position of said blade relative to said reference line; and displaying the position of said blade relative to said user defined offset.

83. An earth-working machine comprising:

a blade;

a blade controller for moving said blade;

a computer having stored therein a reference line and a three dimensional computer model of a desired topography;

said computer being configured to prompt a user for a user defined offset relative to a reference line, determine a blade position in local coordinates, convert said local coordinates to reference line coordinates, including reference station and reference offset values, compare said user defined offset to said reference offset, and send blade movement commands to said blade controller.

* * * * *